US010695625B2

(12) United States Patent
Henrikson et al.

(10) Patent No.: US 10,695,625 B2
(45) **Date of Patent: *Jun. 30, 2020**

(54) GOLF CLUB HEADS WITH TURBULATORS AND METHODS TO MANUFACTURE GOLF CLUB HEADS WITH TURBULATORS

(71) Applicant: KARSTEN MANUFACTURING CORPORATION, Phoenix, AZ (US)

(72) Inventors: Erik M. Henrikson, Phoenix, AZ (US); Paul D. Wood, Phoenix, AZ (US); John Hart, Shefield (GB); Marty R. Jertson, Cave Creek, AZ (US); Bradley D. Schweigert, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/421,283

(22) Filed: May 23, 2019

(65) Prior Publication Data

US 2019/0275386 A1 Sep. 12, 2019

Related U.S. Application Data

(63) Continuation of application No. 15/354,697, filed on Nov. 17, 2016, now Pat. No. 10,300,349, which is a (Continued)

(51) Int. Cl.

| | |
|---|---|
| ***A63B 53/04*** | (2015.01) |
| ***A63B 60/52*** | (2015.01) |
| ***A63B 60/00*** | (2015.01) |

(52) U.S. Cl.

CPC ..... *A63B 53/0466* (2013.01); *A63B 53/04* (2013.01); *A63B 60/52* (2015.10); *A63B 53/047* (2013.01); *A63B 53/0487* (2013.01); *A63B 2053/0408* (2013.01); *A63B 2053/0412* (2013.01); *A63B 2053/0433* (2013.01); *A63B 2053/0437* (2013.01);

(Continued)

(58) Field of Classification Search

CPC ..... A63B 53/0466; A63B 53/04; A63B 60/52; A63B 2060/002; A63B 53/0487; A63B 53/047; A63B 2053/0412; A63B 2053/0437; A63B 2053/0408; A63B 2053/0433; A63B 2225/01; A63B 2060/006

USPC ..... 473/324–350, 287–292

See application file for complete search history.

(56) References Cited

U.S. PATENT DOCUMENTS

D192,515 S 4/1962 Henrich
3,997,170 A * 12/1976 Goldberg ..... A63B 53/04 473/327

(Continued)

FOREIGN PATENT DOCUMENTS

JP 03114477 5/1995

*Primary Examiner* — Sebastiano Passaniti

(57) ABSTRACT

A golf club head includes a crown surface having an apex at a highest point and extending between the face, the rear, the heel and the toe of the golf club head. The golf club head also includes a plurality of crown turbulators projecting from the surface of the crown and located between the face and the apex, wherein each adjacent pair of crown turbulators is separate and spaced apart to define a space between the adjacent pair of crown turbulators.

20 Claims, 20 Drawing Sheets

Related U.S. Application Data continuation of application No. 14/710,420, filed on May 12, 2015, now Pat. No. 9,555,294, which is a continuation of application No. 14/093,967, filed on Dec. 2, 2013, now Pat. No. 9,168,432, which is a continuation-in-part of application No. 13/536,753, filed on Jun. 28, 2012, now Pat. No. 8,608,587.

(60) Provisional application No. 61/775,982, filed on Mar. 11, 2013, provisional application No. 61/651,392, filed on May 24, 2012, provisional application No. 61/553,428, filed on Oct. 31, 2011.

(52) U.S. Cl.
CPC ... *A63B 2060/002* (2015.10); *A63B 2060/006* (2015.10); *A63B 2225/01* (2013.01); *Y10T 29/49* (2015.01); *Y10T 29/49826* (2015.01)

(56) References Cited

U.S. PATENT DOCUMENTS 4,065,133 A * 12/1977 Gordos ..... A63B 53/04 473/327
4,077,633 A 3/1978 Studen
4,139,196 A 2/1979 Edward
4,754,974 A 7/1988 Kobayashi
4,930,783 A 6/1990 Antonious
5,092,599 A * 3/1992 Okumoto ..... A63B 53/04 473/327
5,190,289 A 3/1993 Nagal et al.
5,193,810 A 3/1993 Antonious
5,203,565 A 4/1993 Murray et al.
5,213,328 A 5/1993 Long et al.
5,213,329 A 5/1993 Okumoto
5,221,086 A 6/1993 Antonious
5,271,622 A * 12/1993 Rogerson ..... A63B 53/04 473/234
D354,784 S * 1/1995 Long ..... D21/752
5,441,263 A 8/1995 Goman
5,456,469 A 10/1995 MacDougall
5,467,989 A 11/1995 Good et al.
5,511,786 A 4/1996 Antonious
5,533,728 A 7/1996 Pehoski et al.
5,544,884 A 8/1996 Hardman
5,575,725 A * 11/1996 Olsavsky ..... A63B 53/04 473/317
5,632,695 A 5/1997 Hlinka et al.
D394,688 S 5/1998 Fox
5,766,095 A 6/1998 Antonious
5,980,394 A 11/1999 Domas
D425,157 S 5/2000 Reed et al.
6,074,308 A 6/2000 Domas
D434,820 S 12/2000 Reed et al.
6,319,148 B1 11/2001 Leung
6,605,006 B2 8/2003 Mason
6,679,781 B1 1/2004 Green
6,773,359 B1 8/2004 Lee
D549,792 S 8/2007 Monty
7,258,625 B2 8/2007 Kawaguchi et al.
7,281,992 B2 10/2007 Tseng
D584,783 S 1/2009 Barez et al.
7,500,924 B2 3/2009 Yokota
7,618,330 B2 11/2009 Krewalk et al.
7,641,568 B2 1/2010 Hoffman et al.
7,988,565 B2 8/2011 Abe
8,118,689 B2 2/2012 Beach et al.
8,162,775 B2 4/2012 Tavares et al.
8,235,841 B2 * 8/2012 Stites ..... A63B 53/04 473/328
8,328,658 B2 * 12/2012 Bennett ..... A63B 53/02 473/328
8,360,900 B2 1/2013 Snyder
8,366,565 B2 2/2013 Tavares et al.
8,485,917 B2 7/2013 Tavares et al.
8,556,742 B2 10/2013 Stites
8,608,587 B2 * 12/2013 Henrikson ..... A63B 53/0466 473/324
8,753,224 B1 6/2014 Kim
8,777,773 B2 7/2014 Burnett et al.
8,821,309 B2 9/2014 Boyd et al.
8,821,311 B2 9/2014 Tavares et al.
8,864,601 B1 10/2014 Ehlers
9,168,432 B2 * 10/2015 Henrikson ..... A63B 53/0466
9,314,677 B2 4/2016 Stites et al.
9,370,696 B2 6/2016 Tavares et al.
9,375,617 B2 6/2016 Boyd et al.
9,555,294 B2 * 1/2017 Henrikson ..... A63B 53/0466
9,802,085 B2 10/2017 Stites et al.
9,839,818 B2 12/2017 Jertson et al.
9,956,459 B2 5/2018 Tavares et al.
10,232,232 B2 * 3/2019 Henrikson ..... A63B 53/0466
10,300,349 B2 * 5/2019 Henrikson ..... A63B 53/0466
2002/0077195 A1 6/2002 Carr et al.
2003/0220154 A1 * 11/2003 Anelli ..... A63B 53/0466 473/327
2010/0009771 A1 1/2010 Newcomer
2010/0016095 A1 1/2010 Burnett et al.
2010/0029408 A1 * 2/2010 Abe ..... A63B 53/0466 473/345
2015/0238826 A1 8/2015 Llewellyn et al.

* cited by examiner

Fig. 21
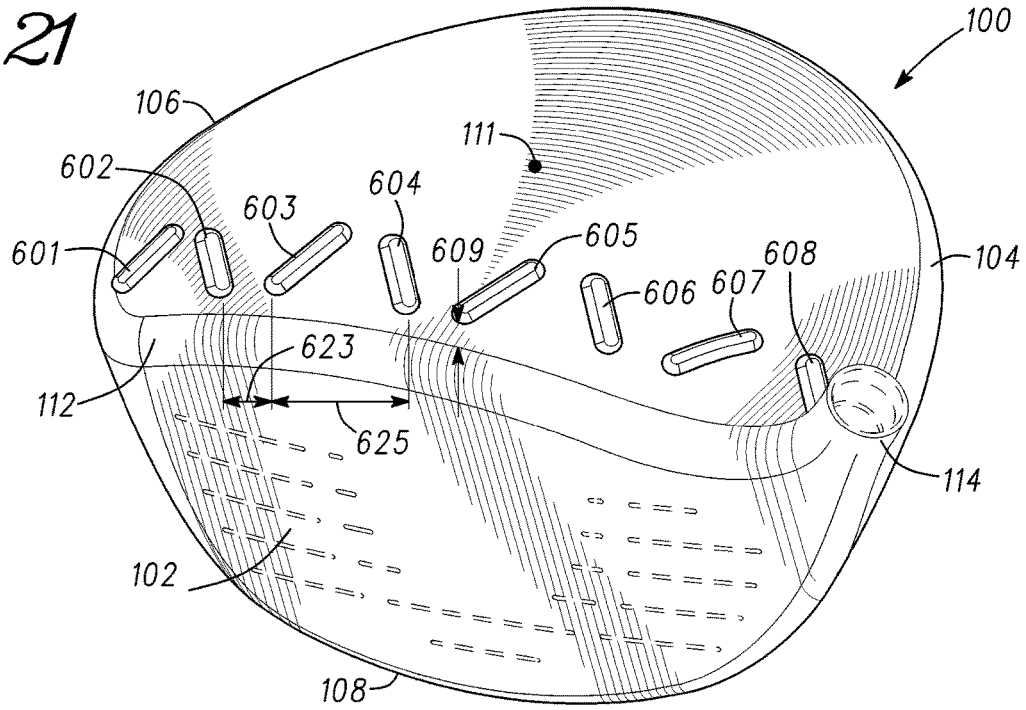
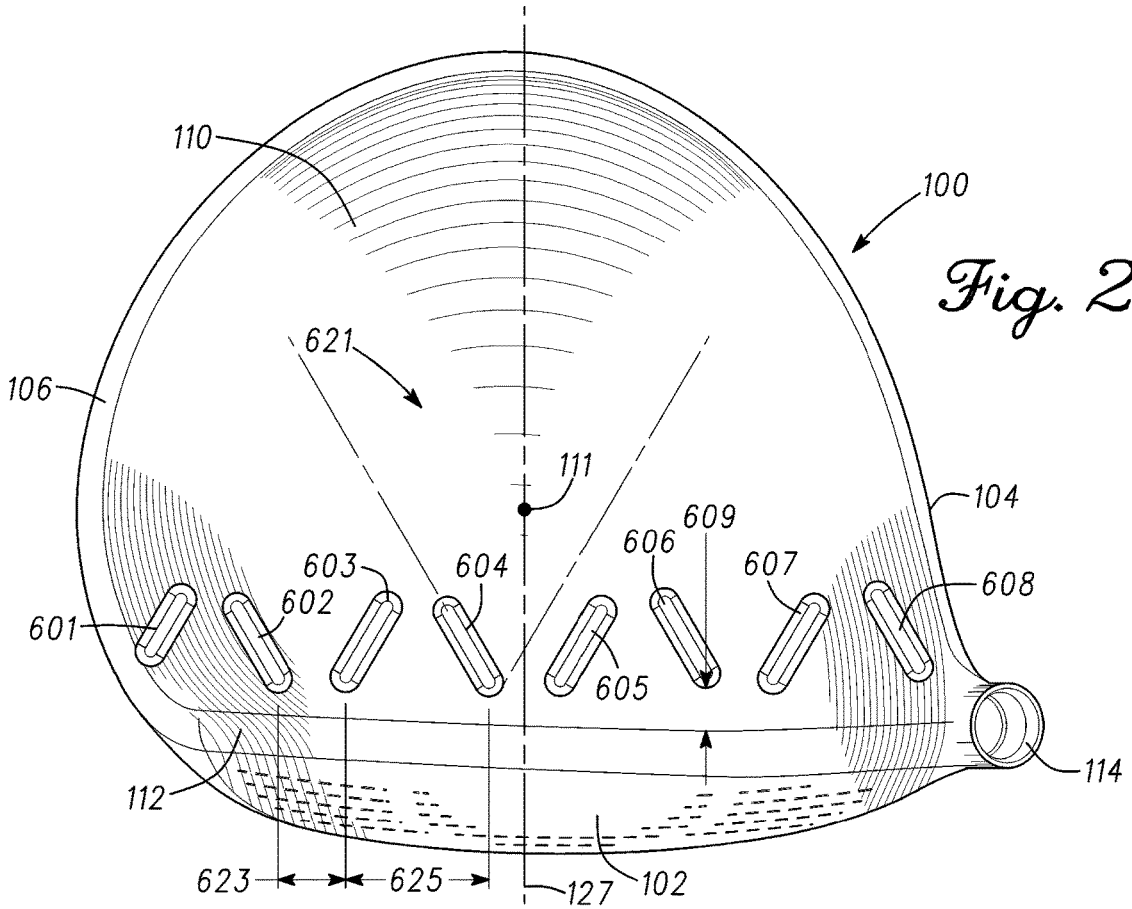
Fig. 22

Fig. 43
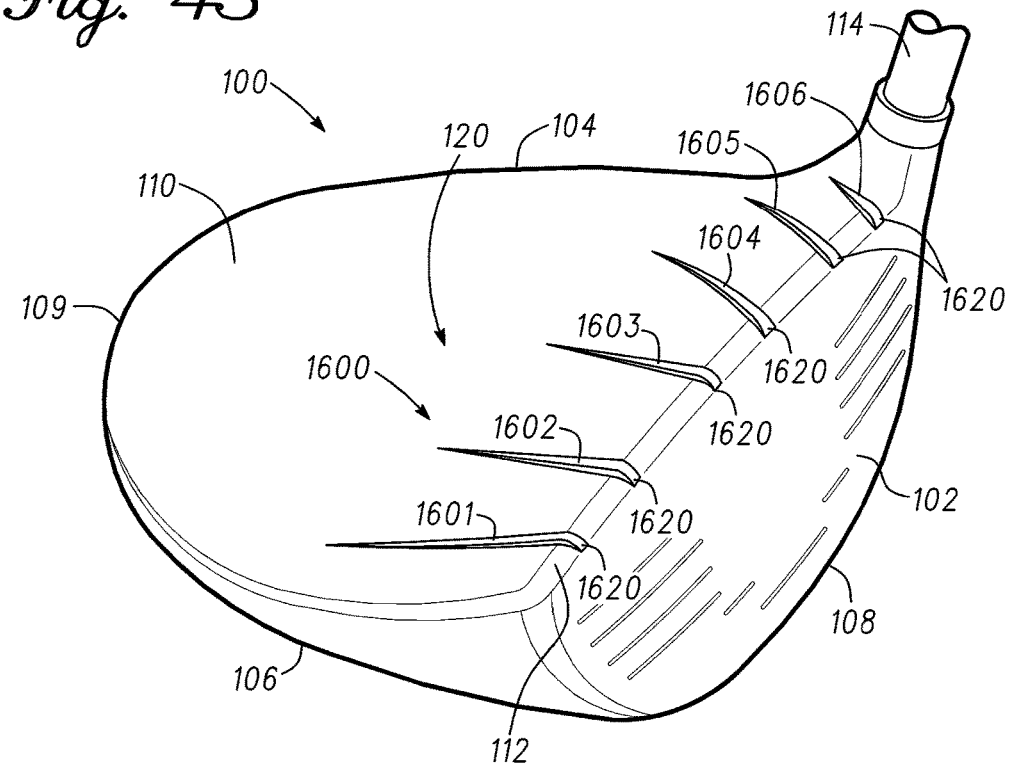
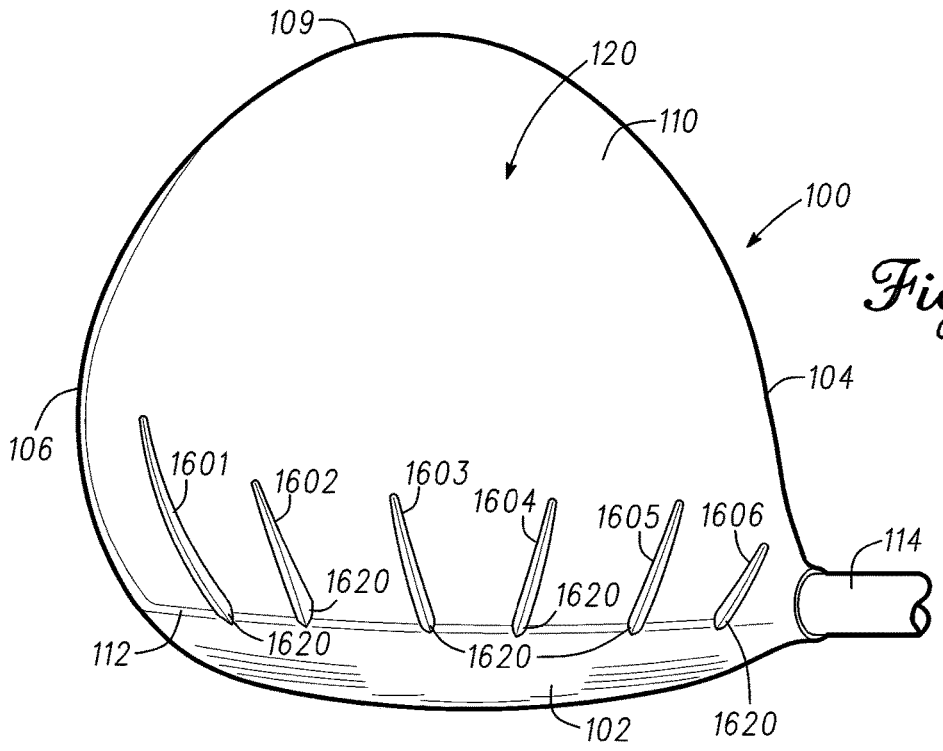
Fig. 44

GOLF CLUB HEADS WITH TURBULATORS AND METHODS TO MANUFACTURE GOLF CLUB HEADS WITH TURBULATORS

CROSS REFERENCE TO RELATED APPLICATION

This is a continuation of U.S. patent application Ser. No. 15/354,697, filed on Nov. 17, 2016, which is a continuation of U.S. patent application Ser. No. 14/710,420, filed on May 12, 2015, now U.S. Pat. No. 9,555,294, which is a continuation of U.S. patent application Ser. No. 14/093,967, filed on Dec. 2, 2013, now U.S. Pat. No. 9,168,432, which claims the benefit of U.S. Provisional Patent Application No. 61/775,982, filed on Mar. 11, 2013; U.S. patent application Ser. No. 14/710,420 is also a continuation in part of U.S. patent application Ser. No. 13/536,753, filed on Jun. 28, 2012, now U.S. Pat. No. 8,608,587, which claims the benefit of U.S. Provisional Patent Application No. 61/553,428, filed on Oct. 31, 2011, and U.S. Provisional Patent Application No. 61/651,392, filed on May 24, 2012, the contents of all of which are incorporated fully herein by reference.

FIELD

The present application generally relates to golf clubs, and more particularly, to golf club heads with turbulators and methods to manufacture golf club heads with turbulators.

BACKGROUND

When air flows over a golf club head, viscous forces near the surface of the club head create a velocity gradient from the surface to the free stream region. Accordingly, air flow velocity near the surface may be relatively slow and gradually increases toward the free stream velocity, which is the air flow region where air velocity is not influenced by the club head. This velocity gradient region is called a boundary layer. Flow separation occurs when the boundary layer travels on the golf club head far enough against an adverse pressure gradient that the air flow velocity in the boundary layer relative to the surface of the club head falls almost to zero. The air flow becomes detached from the surface of the club head and takes the form of eddies and vortices. Flow separation may result in increased drag, which may be caused by the pressure differential between the front and rear surfaces of the club head. The increased drag may reduce the speed of the club head, which in turn may lower the velocity of a golf ball that is struck by the club head.

BRIEF DESCRIPTION OF THE DRAWINGS

FIGS. 21 and 22 are perspective views of a club head having a turbulator according to one embodiment.

FIGS. 43 and 44 are perspective side and top views, respectively, of a club head having turbulators according to one embodiment.

DETAILED DESCRIPTION

Figure 1:
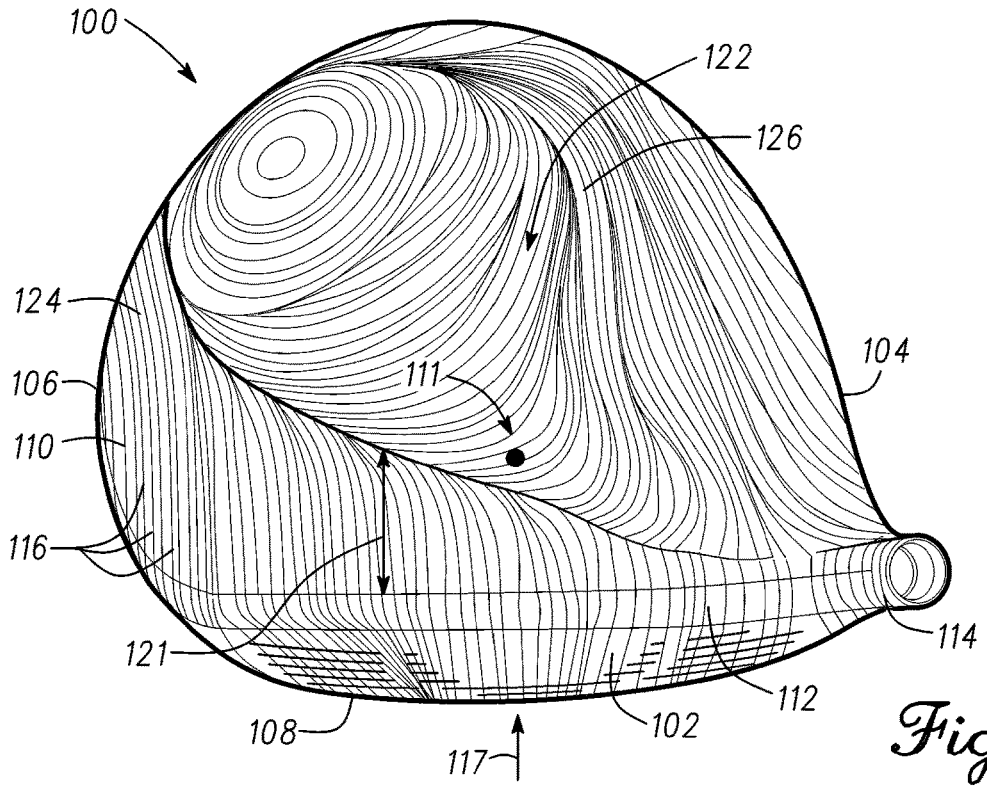
FIG. 1 is a top perspective view of a club head showing air flow streamlines on the club head.

Referring to FIG. 1, a golf club head 100 is shown, which includes a face 102 that extends horizontally from a heel end 104 to a toe end 106 and vertically from a sole 108 to a crown 110. A transition region between the face 102 and the crown 110 defines a leading edge 112. The highest point on the crown 110 defines an apex 111. The club head 100 also includes a hosel 114 for receiving a shaft (not shown). The club head 100 is a wood-type club head. However, the present disclosure is not limited to wood-type club heads and applies to any type of golf club head (e.g., a driver-type club head, a fairway wood-type club head, a hybrid-type club head, an iron-type club head, a wedge-type club head, or a putter-type club head). The apparatus, methods, and articles of manufacture described herein are not limited in this regard.

FIG. 1 shows an exemplary air flow pattern on the club head 100 with streamlines 116. Air flowing in the direction of the arrow 117 flows over the crown 110 from the leading edge 112 toward the rear section of the crown 110. The airflow may remain attached to the crown 110 from the leading edge 112 to a separation region 120 located at a certain separation distance 121 from the leading edge 112. The separation may occur in a narrow strip on the crown 110, hence the separation region 120 may also be referred to herein as a separation line 120. As shown in FIG. 1, the distance 121 may vary from the heel end 104 to the toe end 106 depending on the physical characteristics of the club head 100. At the separation region 120, the airflow detaches from the crown 110 and creates a wake region 122, which is defined by the airflow becoming turbulent or forming eddies and vortices in the free stream region. The pressure differential between the wake region 122 and the attached flow region on the crown 110 creates a pressure drag on the club head 100. The pressure drag reduces the speed of the club head 100, hence affecting the speed by which a ball is hit with the club head 100. To maintain the air flow attached on the crown 110 for a longer distance 121, the air flow in the boundary layer before the separation region 120 can be energized to delay air flow detachment or to move the separation region 120 farther back on the crown 110. To energize the boundary layer, which may be laminar upstream of the separation region 120, the boundary layer can be made turbulent (or more turbulent if the flow is turbulent) upstream of the separation region 120.

Figure 2:
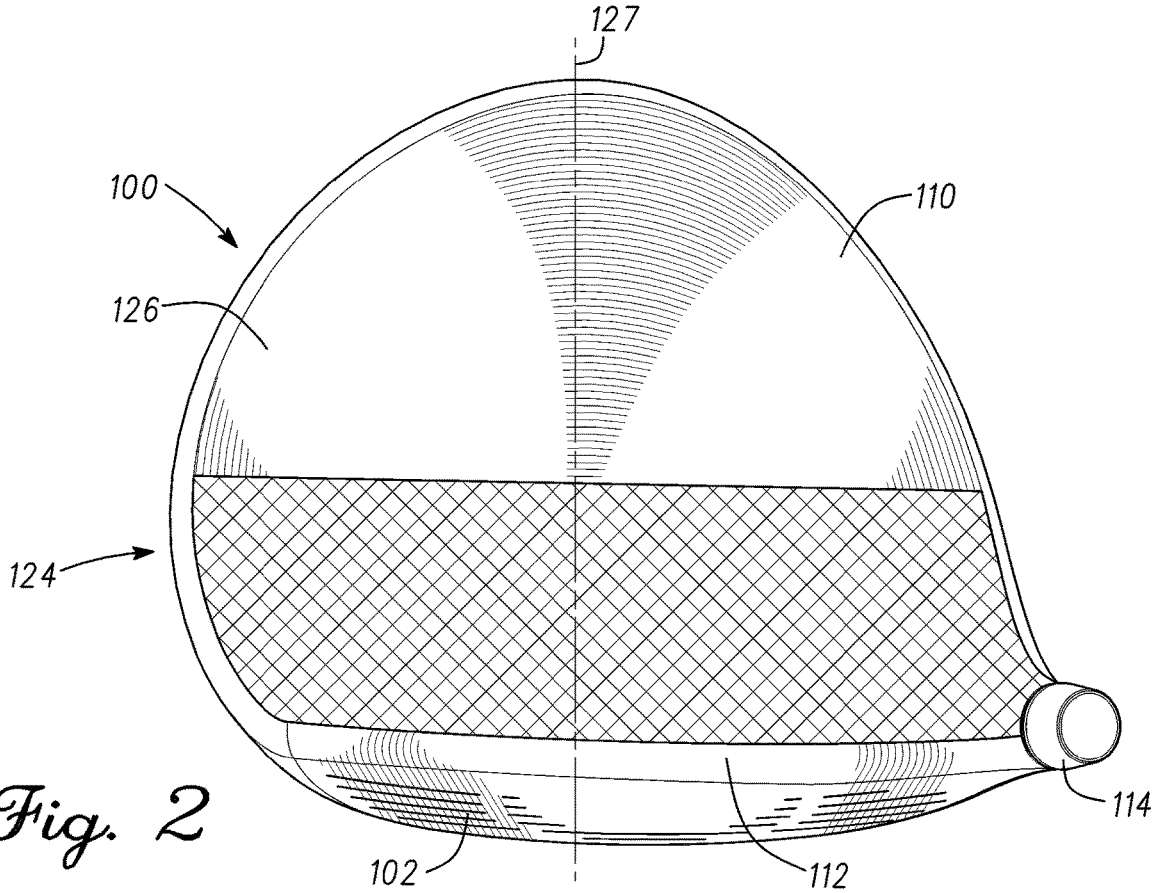
FIG. 2 is a top perspective view of a club head shown front and aft regions of a crown of the club head.
Figure 3:
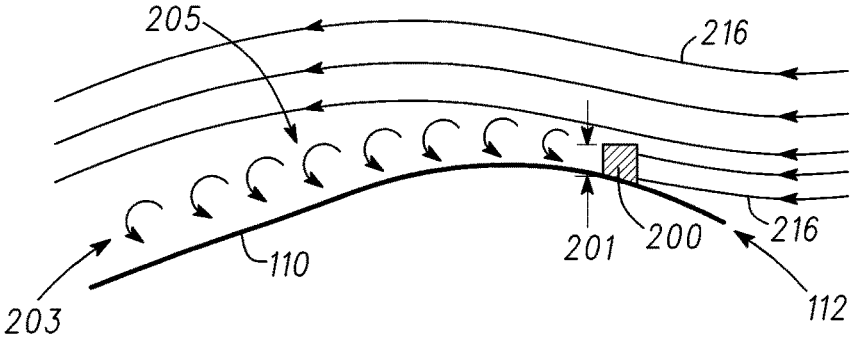
FIG. 3 is a schematic cross-sectional diagram of a turbulator according to one embodiment.

To delay air flow separation or detachment as described above, the golf club head 100 includes turbulators positioned on the crown 110 as described in detail below. Referring to FIG. 2, the turbulators may be positioned in the front region 124 of the crown 110 and before the separation region 120 to delay air flow separation or move the separation region 120 toward the rear region 126 of the crown 110. A schematic diagram of an exemplary turbulator 200 is shown in cross section in FIG. 3. The turbulator 200 projects upward from the crown 110 at a height 201 such that it is inside the boundary layer 203. The turbulator 200 trips the air flowing over the crown 110 as shown by the streamline 216 to create turbulence 205 inside the boundary layer 203. The turbulence energizes the boundary layer 203 to delay separation of the air flow on the crown 110 and move the separation region 120 toward the aft region 126 of the crown 110. In other words, the turbulators according to the disclosure increase the distance 121 shown in FIG. 1.

Figure 4:
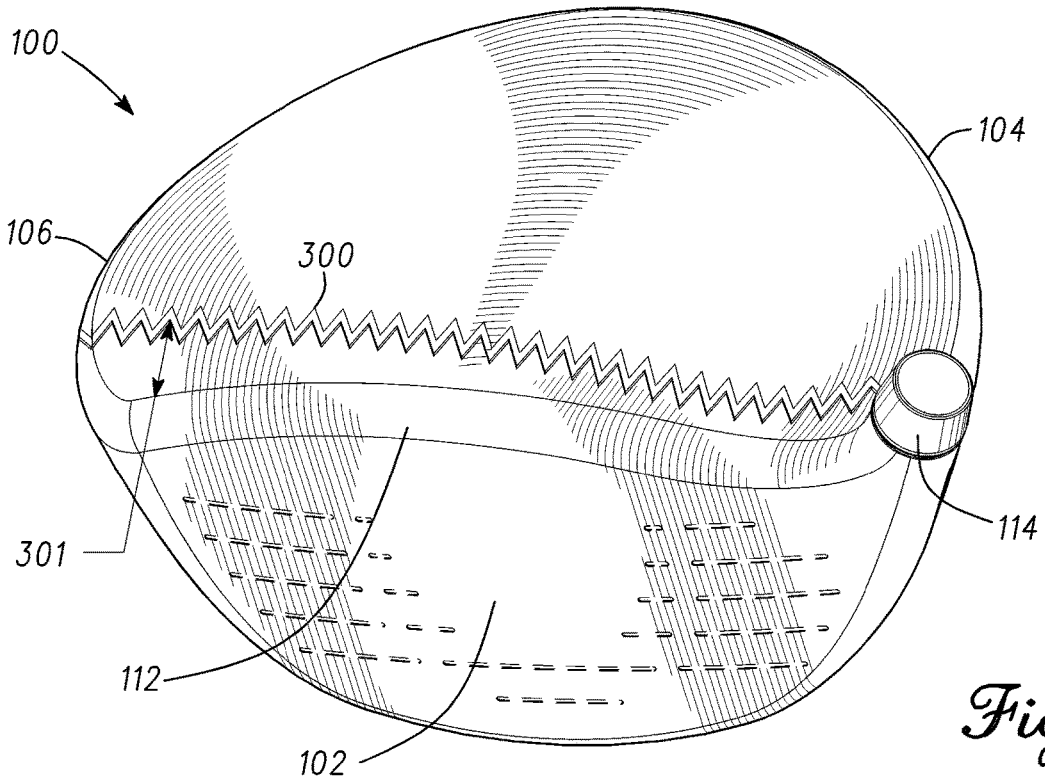
FIG. 4 is a perspective view of a club head having a turbulator according to one embodiment.

An example of a turbulator 300 is shown in FIG. 4. The turbulator 300 energizes the boundary layer on the crown 110 by generating turbulence in the boundary layer. The turbulator 300 is located on the crown 110 at a constant or variable distance 301 downstream of the leading edge 112 and may extend from the hosel 114 or the heel end 104 to the toe and 106. The turbulator 300 provides a plurality of projected surfaces in discrete or continuous form on the surface of the crown 110 at a height (not showing FIGS. 4-8, but generally shown with reference number 201 in FIG. 3). When the air flowing over the crown 110 encounters the projected surfaces of the turbulator 300, the air trips and becomes turbulent inside the boundary layer to energize the boundary layer.

Figure 5:
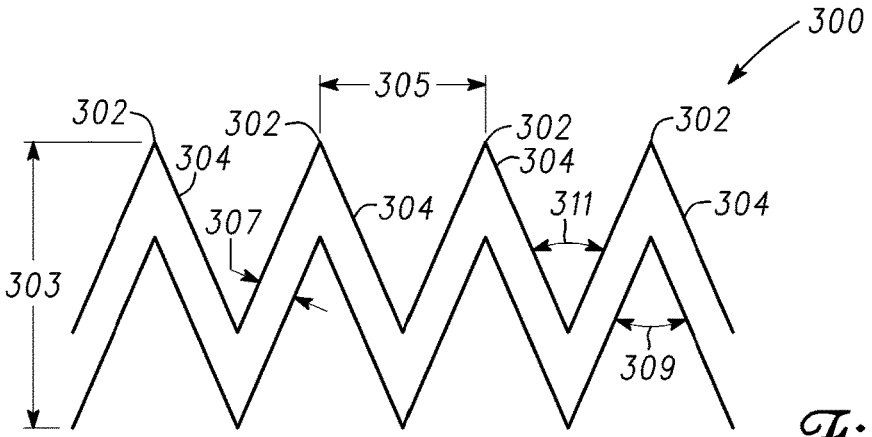
FIG. 5 is a schematic diagram of the turbulator of FIG. 4.
Figure 6:
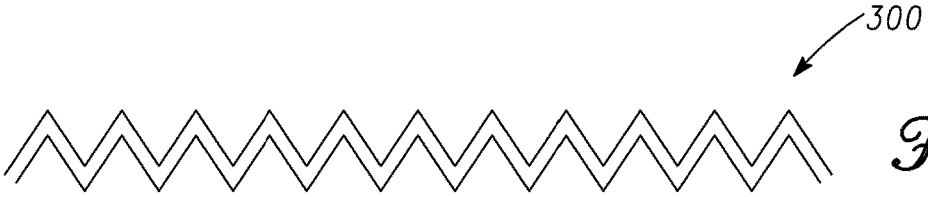
FIGS. 6-8 show examples of different turbulators according to the embodiment of FIG. 4.
Figure 7:
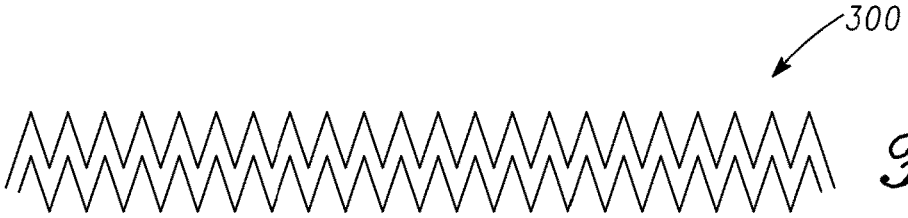
Figure 8:
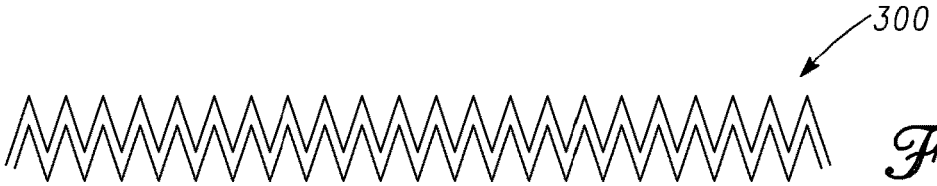

The turbulator 300 shown in the example of FIG. 4 is formed by a strip having a zigzag pattern. Referring to FIG. 5, the zigzag pattern provides peaks 302 and swept back surfaces 304. The peaks 302 and the swept back surfaces 304 provide continuous tripping of the air flow across the width 303 of the turbulator 300. The peaks 302 are spaced apart by a distance 305 and the turbulator 300 has a thickness 307, a height (not shown in FIGS. 4-8), and surface characteristics that may affect air flow. The peaks 302 are defined by a peak angle 309 and the angle between two adjacent peaks 302 is defined by a valley angle 311. Referring to FIGS. 6-8, the width 303, the distance 305, the thickness 307, the height and/or the angles 309 and 311 may be different for each application to provide a particular flow pattern over the crown 110. The surface characteristics of the turbulator 300 may also vary to provide a certain flow pattern over the crown 110. The surface characteristics of the turbulator 300 may refer to the roughness or smoothness of the top surface of the turbulator 300. In the examples of FIGS. 6-8, the turbulator 300 shown in FIG. 7 may provide greater turbulence in a boundary layer than the turbulator 300 of FIG. 6. Accordingly, the turbulator 300 of FIG. 7 may be suitable in a certain application depending on the physical characteristics of the club head 100. However, the turbulator 300 of FIG. 6 may be suitable for another type of club head 100. Accordingly, each of the exemplary turbulators 300 of FIGS. 6-8 may be suitable for different club heads 100.

The turbulator 300, for example, may have a height that does not exceed 0.5 inches (1.27 cm). In one embodiment, the turbulator 300 may have a height that is greater than 0.02 inches (0.05 cm) but less than 0.2 inches (0.51 cm). In one embodiment, the width 303 of the turbulator may be less than 0.75 inches (1.91 cm). The turbulator 300 may have a peak-to-peak distance 305 that contributes to the delay in airflow separation. The location of the turbulator 300 may vary depending on the physical characteristics of the club head 100 and the flow pattern on the crown 110. The turbulator 300 may be located on the crown 110 at an oblique angle relative to the club face 102 as shown in FIG. 4, or be parallel to the club face 102 between 0.25 inches (0.64 cm) and 4.5 inches (11.43 cm) from the club face 102. The turbulator 300 may be located in a curvilinear manner on the crown 110 based on the separation region 120 of a particular club head 100. In one embodiment, the turbulator 300 is located between the club face 102 and the apex 111 of the crown 110. Accordingly, the turbulator 300 may be located between the leading edge 112 and the apex 111 of the crown 110. The turbulator 300 may be located on the crown 110 such that the swept back surfaces 304 form an angle of between 20° and 70° degrees relative to the centerline 127 (shown in FIG. 2) of the club head 100.

Referring to FIG. 4, for example, the turbulator 300 may be a strip that extends from the heel end 104 to the toe end 106. Additionally, the distance 301 increases from the heel end 104 to the toe end 106. This increase in the distance 301 positions the turbulator to approximately follow the shape of the separation region 120 shown in FIG. 1. Alternatively, the turbulator 300 may be a curved strip (not shown) that substantially follows the shape of the separation region 120.

The width 303, the distance 305, the thickness 307, the height and/or the angles 309 and 311 may be constant along the length of the turbulator as shown in FIGS. 6-8. However, any one or all of noted parameters may vary along the turbulator 300 from the heel end 104 to the toe end 106 to provide a particular airflow effect. Furthermore, the surface characteristics of the turbulator 300 may be constant or vary along the turbulator 300 from the heel end 104 to the toe end 106. The turbulator 300 may have any pattern similar to the zigzag pattern described above or other patterns that can provide the boundary layer energizing function described above. Such patterns may include various geometric shapes such as square, rectangular, triangular, curved, circular, polygonal or other shapes in discrete or continuous configurations. The apparatus, methods, and articles of manufacture described herein are not limited in this regard.

The turbulator 300 is shown to be a continuous strip in FIG. 4. However, the turbulator 300 may be formed by a plurality of turbulator segments that are positioned on the crown 110 in different configurations relative to each other such as aligned, offset and/or tandem. For example, the turbulator 300 may include three discrete zigzag strips that are positioned at different distances 301 on the crown 110. Each of the discrete strips may have similar or different properties, such as similar or different height, width 303, the distance 305, the thickness 307, the angles 309 and/or 311.

The turbulator 300 may be constructed from any type of material, such as stainless steel, aluminum, titanium, various other metals or metal alloys, composite materials, natural materials such as wood or stone or artificial materials such as plastic. If the turbulator 300 is constructed from metal, it may be formed on the club head 100 or simultaneously with the club head 100 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 100 and/or the turbulator 300. Molten metal or plastic material is injected into the mold, which is then cooled. The club head 100 and/or the turbulator 300 is then removed from the mold and may be machined to smooth out irregularities on the surfaces thereof or to remove residual parts. If the turbulator 300 is manufactured separately from the club head 100, the turbulator 300 can be fixedly or removably attached to the crown 110 with fasteners, adhesive, welding, soldering, or other fastening methods and/or devices. In one example, the turbulator 300 may be formed from a strip of material having an adhesive backing. Accordingly, the turbulator 300 may be attached to the club head 100 at any location on the crown with the adhesive backing.

Figure 9:
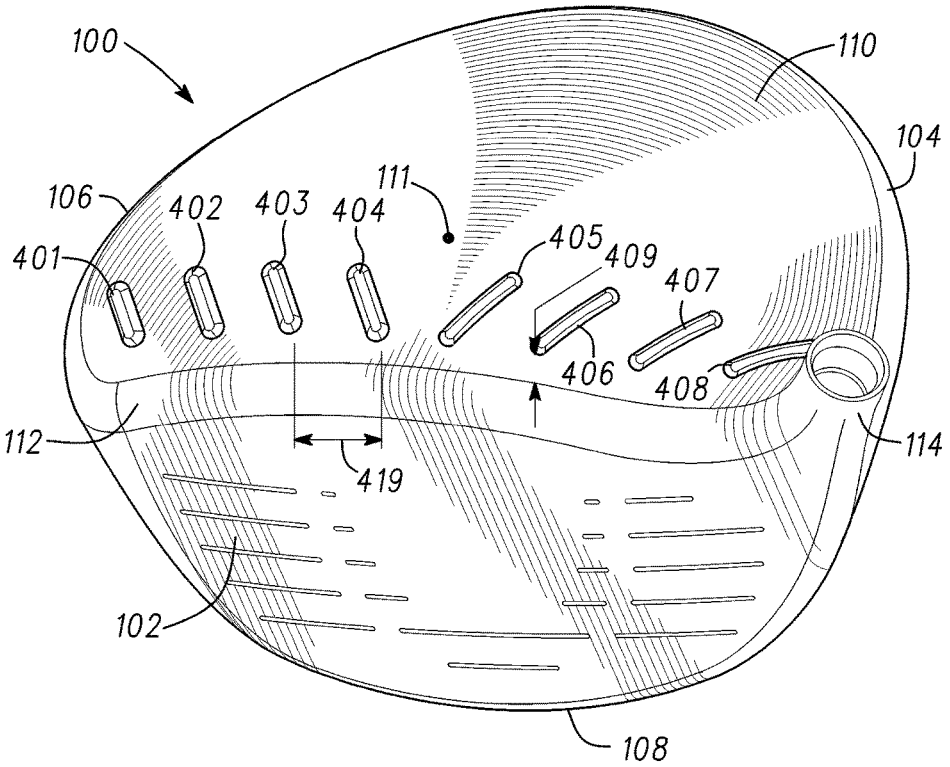
FIGS. 9 and 10 are perspective views of a club head having a turbulator according to one embodiment.
Figure 10:
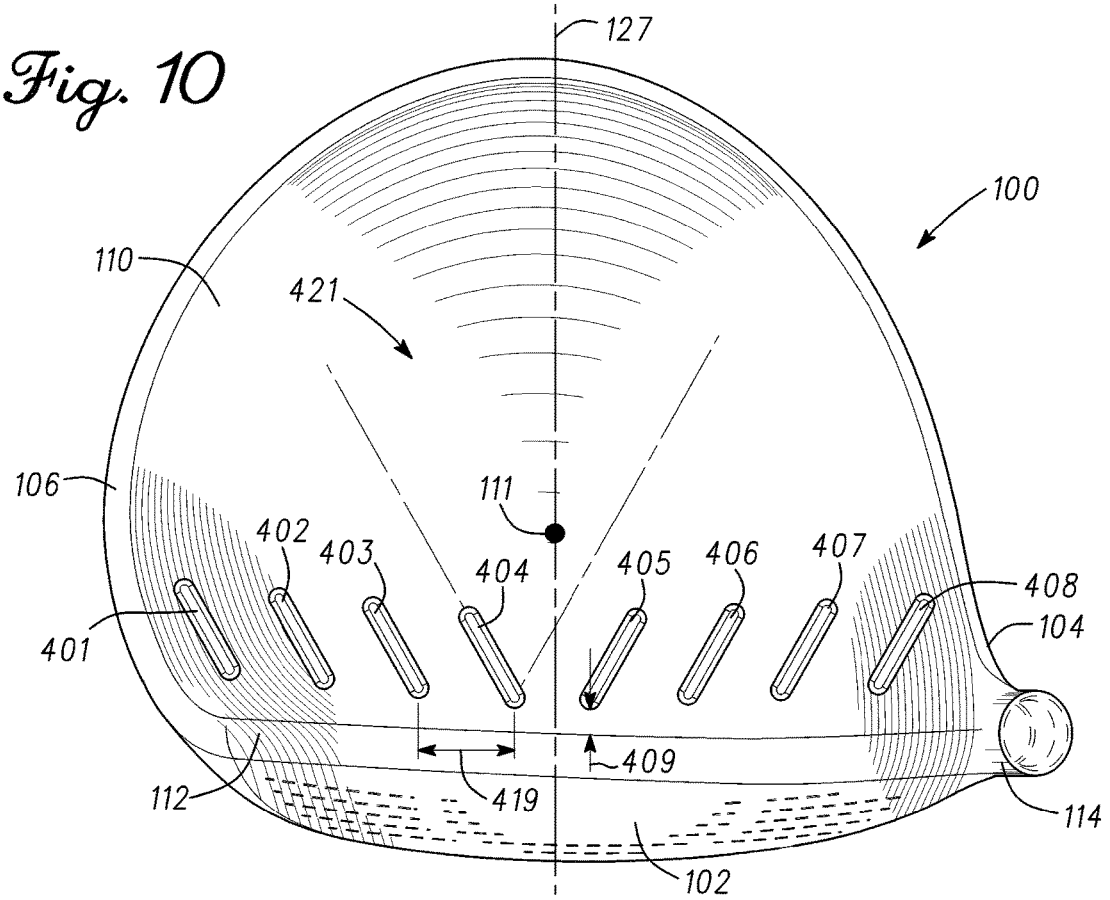

Referring to FIGS. 9 and 10, another exemplary turbulator 400 is shown. The turbulator 400 includes a plurality of ridges 401-408 that are positioned downstream of the leading edge 112 and at least partly before the separation region 120. Each ridge 401-408 may be spaced from the leading edge 112 at the same distance 409 as another ridge or a different distance 409 than another ridge. While FIGS. 9 and 10 may depict a particular number of ridges, the apparatus, methods, and articles of manufacture described herein may include more or less number of ridges. Referring to FIGS. 11-14, in which examples of only the ridge 404 are shown, each ridge 401-408 has a length 411, a base width 413, a height 415 (shown in FIG. 12) and an angle 417 relative to the leading edge 112 of the club head 100. Each ridge 401-408 may be spaced apart from an adjacent ridge by a distance 419 (shown in FIGS. 9 and 10), which is measured from the leading edges 410 of the ridges 401-408 if the ridges are not parallel.

Figure 11:
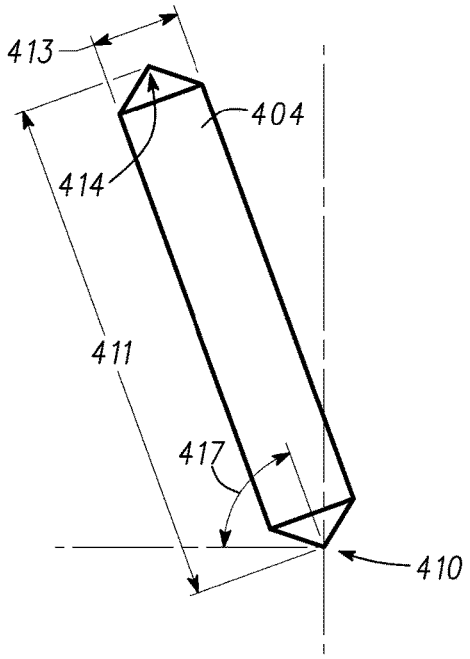
FIG. 11 is a schematic diagram of a section of the turbulator of FIGS. 9 and 10.
Figure 12:
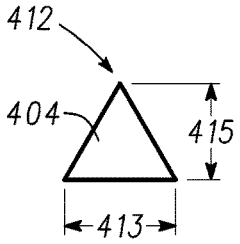
FIGS. 12-14 show different cross-sectional diagrams of turbulators according to the embodiment of FIGS. 9 and 10.
Figure 13:
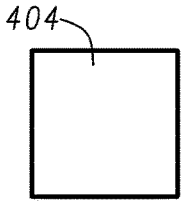
Figure 14:
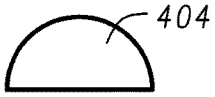

FIG. 11 illustrates an exemplary shape for the ridge 404 and does not in any way limit the shape of the ridges 401-408. The ridges 401-408 may have any cross-sectional shape. In FIGS. 12-14, three exemplary cross-sectional shapes for the ridges 401-408 are shown. The length 411 may be substantially greater than the base width 413. The ridges 401-408 function as vortex generators to energize the boundary layer that forms on the crown 110, hence moving the separation region 120 further aft on the crown 110. Thus, each ridge 401-408 functions as a turbulator. The height 415 of each ridge 401-408 may be such that the top 412 (shown in FIG. 12) of each ridge 402 remains inside the boundary layer. However, any one or more of the ridges may extend above the boundary layer.

The angle 417 for each ridge may be configured so that each ridge 401-408 is oriented generally perpendicular, parallel or oblique relative to the leading edge 112 and/or relative to each other. In one embodiment, the angle 417 may be between 20° and 70°. In the example of FIGS. 9 and 10, the turbulator 400 includes four ridges 401-404 on the toe end side of the club head 100 that are oriented generally at an angle 417 of about 60°-70° and parallel to each other. The turbulator 400 also includes four ridges 405-408 that are symmetric with respect to the angle 417 about a centerline 127 of the club head 100 relative to the ridges 401-404.

Each ridge 401-408 is shown to be a linear. However, each of the ridges 401-408 can be curved, have variable base width 413 along the length 411, have variable cross-sectional shapes, have variable height 415 along the length 411 and/or the base width 413, have sharp or blunt leading edges 410 or trailing edges 414, have sharp or blunt tops 412, have different surface textures, and/or have other physical variations along the length 411, the base width 413 and/or the height 415. The distance 409 may increase for each ridge 401-408 from the heel end 104 to the toe end 106 to approximately correspond with the location of the separation line 120 on the crown 110. However, as shown in FIGS. 9 and 10, each ridge 401-408 may be located on the crown 110 at substantially the same distance 409 from the leading edge 112. Furthermore, each of the ridges 401-408 may be placed anywhere on the crown 110 to provide the boundary layer effects described herein. The location of the ridges may vary depending on the physical characteristics of the club head 100 and the airflow pattern on the crown 110. Each of the ridges 401-408 may be located along a straight line or a curvilinear line on the crown 110 between 0.25 inches (0.64 cm) and 4.5 inches (11.43 cm) from the club face 110. Each ridge 401-408 may have a height 415 that does not exceed 0.5 inches (1.27 cm). In one embodiment, at least one ridge 401-408 may have a height 415 that is greater than 0.02 inches (0.05 cm) but less than 0.2 inches (0.51 cm). The ridges 401-408 may have a distance 419 that contributes to the delay in airflow separation. The ridges 401-408 may be arranged on the crown 110 in a curvilinear manner based on the location of the separation region 120 of a particular club head 100. In one embodiment, the ridges 401-408 are located between the face 102 and the apex 111 of the crown 110. Accordingly, the ridges 402 may be located between the leading edge 112 and the apex 111 of the crown 110.

Referring to FIG. 10, each ridge 401-408 trips the air flowing over the ridge to create small eddies or vortices along the length 411 for energizing the boundary layer downstream of the ridge 401-408 in an area 421 (shown only on ridge 404). Accordingly, the separation region 120 is moved farther aft on the crown 110. The distance 419 between each ridge 401-408, length 411, base width 413, height 415 and/or angle 417 may be configured so that the areas 421 slightly or greatly overlap, or do not overlap. As shown in the example of FIG. 10, the distance 419, the length 411 and the angle 417 of each ridge 401-408 are configured such that the leading edge 410 of each ridge 401-408 is generally aligned along the direction of airflow with the trailing edge 414 of an adjacent ridge 401-408. Thus, the arrangement of the ridges 401-408 on the crown 110 as shown in of FIGS. 9 and 10 provides overlapping areas 421 of boundary layer turbulence. However, the ridges 401-408 can be configured to have any physical characteristics and spaced apart at any distance 419. For example, if the ridges have shorter lengths than the length 411 of the ridges 401-408 shown in FIGS. 9 and 10, the distance 419 can be reduced to ensure overlap of areas 421 downstream of the ridges 401-408. In another example, if the angles 417 of the ridges 401-408 relative to the club face 100 are different than the angle 417 shown in FIGS. 9 and 10, the distance 419 or the lengths 411 of the ridges 401-408 can be accordingly modified to ensure that areas 421 overlap downstream of the ridges 401-408. In yet another example, multiple rows of ridges can be provided on the crown 110 in tandem or offset relative to each other. Thus, any number of ridges with each ridge having any physical characteristic and distance 409 relative to an adjacent ridge can be provided on the crown 110. For example, in certain application, overlapping of the areas 421 may not be suitable. Accordingly, the ridges 401-408 can be configured to reduce, minimize or prevent overlap of the areas 421.

Referring to FIG. 10, the ridges 401-404 are arranged to point toward the centerline 127, and the ridges 405-408 are also arranged to point toward the centerline 127. Accordingly, the ridges 401-408 can function as an alignment aid for a player to align the club face 102 with a ball. An individual standing in an address position may visually determine the position of the ball (not shown) relative to the centerline 127 with the aid of the ridges 401-408.

Figure 15:
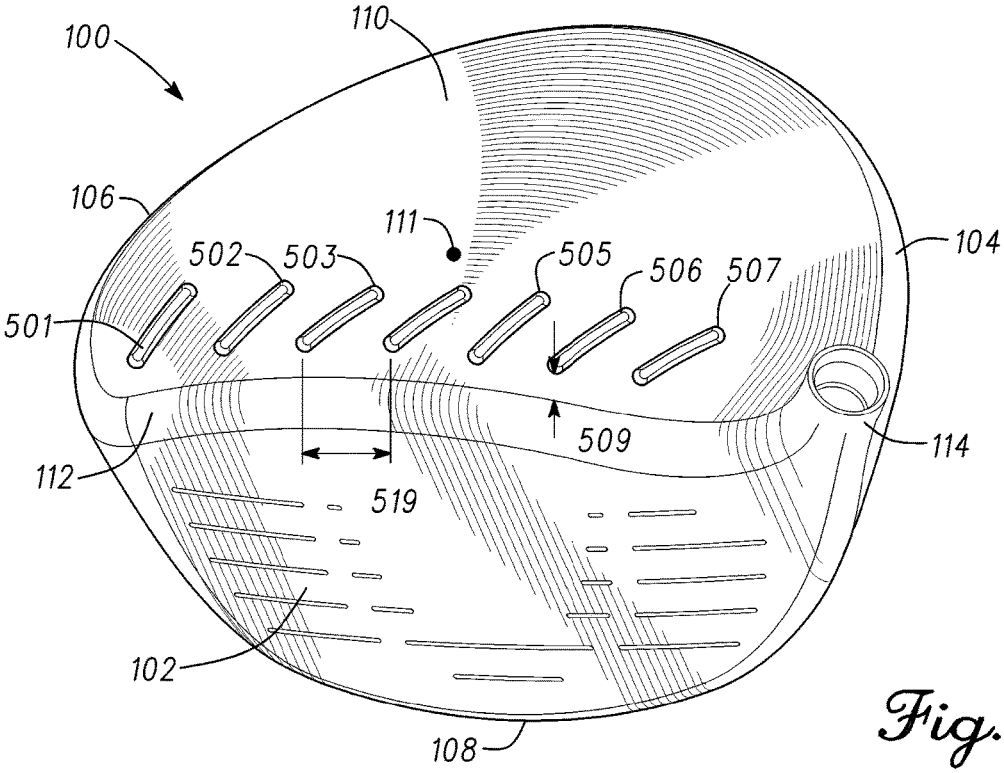
FIGS. 15 and 16 are perspective views of a club head having a turbulator according to one embodiment.
Figure 16:
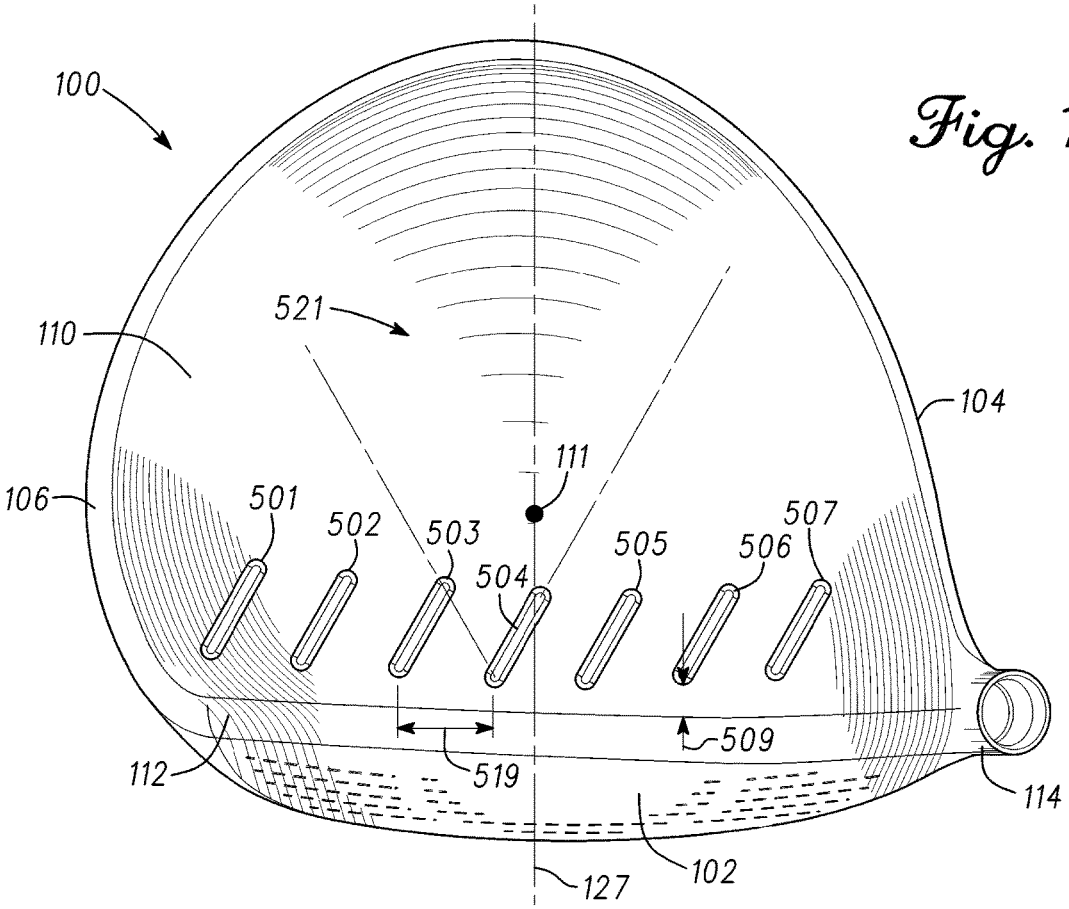

Referring to FIGS. 15 and 16, another exemplary turbulator 500 is shown. The turbulator 500 includes a plurality of ridges 501-507 that are positioned downstream of the leading edge 112 and at least partly before the separation region 120. Each ridge 501-507 may be spaced from the leading edge 112 at the same distance 509 as another ridge or a different distance 509 than another ridge. While FIGS. 15 and 16 may depict a particular number of ridges, the apparatus, methods and articles of manufacture described herein may include more or less number of ridges. Referring to FIGS. 17-20, in which examples of only the ridge 504 are shown, each ridge 501-507 has a length 511, a base width 513, a height 515 (shown in FIG. 18) and an angle 517 relative to the leading edge 112 of the club head 100. Each of the ridges 501-507 is spaced apart from an adjacent ridge by a distance 519 (shown in FIGS. 15 and 16), which is measured from the leading edges 504 of the ridges 501-507 if the ridges are not parallel.

Figure 17:
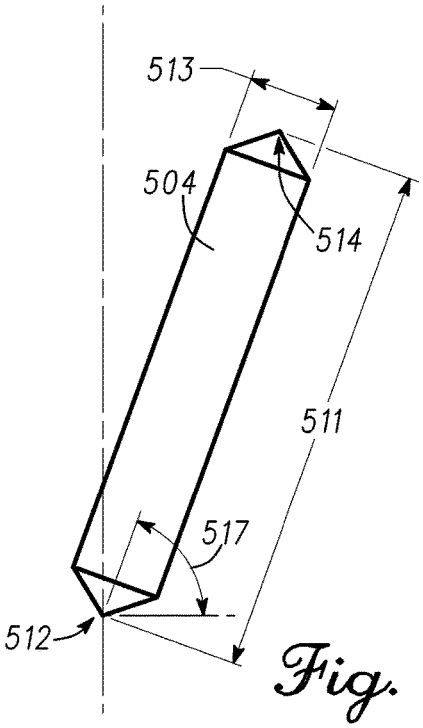
FIG. 17 is a schematic diagram of a section of the turbulator of FIGS. 15 and 16.
Figure 18:
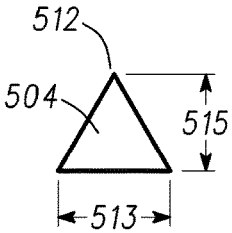
FIGS. 18-20 show different cross-sectional diagrams of turbulators according to the embodiment of FIGS. 15 and 16.
Figure 19:
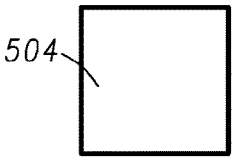
Figure 20:
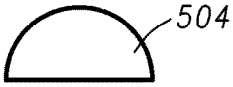

FIG. 17 illustrates an exemplary shape for the ridge 504 and does not in any way limit the shape of the ridges 501-507. The ridges 501-507 may have any cross-sectional shape. In FIGS. 18-20, three exemplary cross-sectional shapes for the ridges 501-507 are shown. The length 511 may be substantially greater than the base width 513. The ridges 501-507 function as vortex generators to energize the boundary layer that forms on the crown 110, hence moving the separation region 120 further aft on the crown 110. Thus, each ridge 501-507 functions as a turbulator. The height 515 of each ridge 501-507 may be such that the top 512 (shown in FIG. 18) of each ridge 501-507 remains inside the boundary layer. However, any one or more of the ridges may extend above the boundary layer.

The angle 517 for each ridge may be configured so that each ridge 501-507 is oriented generally perpendicular, parallel or oblique relative to the leading edge 112 and/or relative to each other. In one embodiment, the angle 517 may be between 20° and 70°. In the example of FIGS. 15 and 16, the turbulator 500 includes seven ridges 501-507 that are oriented generally at an angle 517 of about 60°-70° and parallel to each other.

Each ridge 501-507 is shown to be a linear. However, each of the ridges 501-507 can be curved, have variable base width 513 along the length 511, have variable cross-sectional shapes, have variable height 515 along the length 511 and/or the base width 513, have sharp or blunt leading edges 510 or trailing edges 514, have sharp or blunt tops 512, have different surface textures, and/or have other physical variations along the length 511, the base width 513 and/or the height 515. The distance 509 may increase for each ridge 501-507 from the heel end 104 to the toe end 106 to approximately correspond with the location of the separation line 120 on the crown 110. However, as shown in FIGS. 15 and 16, each ridge 501-507 may be located at substantially the same distance 509 from the leading edge 112. Furthermore, each of the ridges 501-507 may be placed anywhere on the crown 110 to provide the boundary layer effects described herein. The location of the ridges may vary depending on the physical characteristics of the club head 100 and the airflow pattern on the crown 110. Each of the ridges 501-507 may be located along a straight line or a curvilinear line on the crown 110 between 0.25 inches (0.64 cm) and 4.5 inches (11.43 cm) from the club face 110. Each ridge 501-507 may have a height 515 that does not exceed 0.5 inches (1.27 cm). In one embodiment, at least one ridge 501-507 may have a height 515 that is greater than 0.02 inches (0.05 cm) but less than 0.2 inches (0.51 cm). The ridges 501-507 may have a distance 519 that contributes to the delay in airflow separation. The ridges 501-507 may be arranged on the crown 110 in a curvilinear manner based on the location of the separation region 120 of a particular club head 100. In one embodiment, the ridges 501-507 are located prior to the apex 111 of the crown 110. Accordingly, the ridges 501-507 may be located between the leading edge 112 and the apex 111 of the crown 110.

Referring to FIG. 16, each ridge 501-507 trips the air flowing over the ridge to create small eddies or vortices along the length 511 for energizing the boundary layer downstream of the ridge 501-507 in an area 521 (shown only on ridge 504). Accordingly, the separation region 120 is moved farther aft on the crown 110. The distance 519 between each ridge 501-507, length 511, base width 513, height 515 and/or angle 517 may be configured so that the areas 521 slightly or greatly overlap, or do not overlap. As shown in the example of FIG. 16, the distance 519, the length 511 and the angle 517 of each ridge 501-507 are configured such that the leading edge 510 of each ridge 501-507 is generally aligned along the direction of airflow with the trailing edge 514 of an adjacent ridge 501-507. Thus, the arrangement of the ridges 501-507 on the crown 110 as shown in of FIGS. 15 and 16 provides overlapping areas 521 of boundary layer turbulence. However, the ridges 501-507 can be configured to have any physical characteristics and spaced apart at any distance 519. For example, if the ridges have shorter lengths than the length 511 of the ridges 501-507 shown in FIGS. 15 and 16, the distance 519 can be reduced to ensure overlap of areas 521 downstream of the ridges 501-507. In another example, if the angles 517 of the ridges 501-507 relative to the club face 100 are different than the angle 517 shown in FIGS. 15 and 16, the distance 519 or the lengths 511 of the ridges 501-507 can be accordingly modified to ensure that areas 521 overlap downstream of the ridges 501-507. In yet another example, multiple rows of ridges can be provided on the crown 110 in tandem or offset relative to each other. Thus, any number of ridges with each ridge having any physical characteristic and distance 509 relative to an adjacent ridge can be provided on the crown 110. For example, in certain application, overlapping of the areas 521 may not be suitable. Accordingly, the ridges 501-507 can be configured to reduce minimize or prevent overlap of the areas 521.

Referring to FIGS. 21 and 22, another exemplary turbulator 600 is shown. The turbulator 600 includes a plurality of ridges 601-608 that are positioned downstream of the leading edge 112 and at least partly before the separation region 120. Each ridge 601-608 may be spaced from the leading edge 112 at the same distance 609 as another ridge or at a different distance 609 than another ridge. While FIGS. 21 and 22 may depict a particular number of ridges, the apparatus, methods, and articles of manufacture described herein may include more or less number of ridges. Referring to FIGS. 22-26, in which examples of only the ridge 604 are shown, each ridge 601-608 has a length 611, a base width 613, a height 615 (shown in FIG. 24) and an angle 617 relative to leading edge 112 of the club head 100. Each of the ridges 601-608 is spaced apart from an adjacent ridge by either a first peak-to-peak distance 623 or a second peak-to-peak distance 625 (shown in FIGS. 21 and 22), where 623 and 625 are measured from the leading edges 604 of adjacent ridges 601-608.

Figure 23:
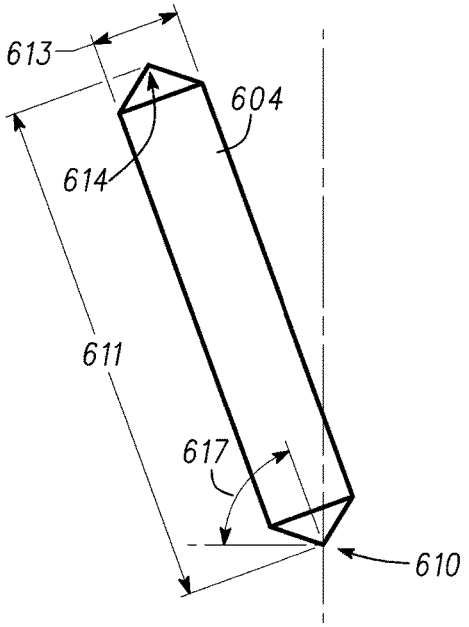
FIG. 23 is a schematic diagram of a section of the turbulator of FIGS. 21 and 22.
Figure 24:
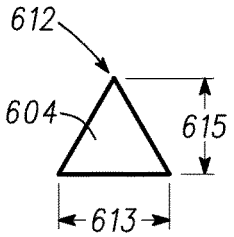
FIGS. 24-26 show different cross-sectional diagrams of turbulators according to the embodiment of FIGS. 21 and 22.
Figure 25:
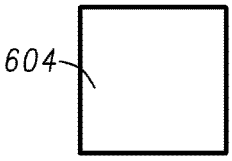
Figure 26:
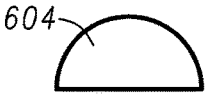

FIG. 23 illustrates an exemplary shape for a ridge 604 and does not in any way limit the shape of the ridges 601-608. The ridges 601-608 may have any cross-sectional shape. In FIGS. 24-26, three exemplary cross-sectional shapes for the ridges 601-608 are shown. The length 611 may be substantially greater than the base width 613. The ridges 601-608 function as vortex generators to energize the boundary layer forming on the crown 110, hence moving the separation region 120 further aft on the crown 110. Thus, each ridge 601-608 functions as a turbulator. The height 615 of each ridge 601-608 may be such that the top 612 (shown in FIG. 24) of each ridge 601-608 remains inside the boundary layer.

The angle 617 for each ridge may be configured so that each ridge 601-608 is oriented generally perpendicular, parallel or oblique relative to the leading edge 112 and/or relative to each other. In one embodiment, the angle 617 may be between 20° and 70° in the absolute value. In the example of FIGS. 21 and 22, the turbulator 600 includes eight ridges 601-608. The ridges 601, 603, 605 and 607 are oriented generally at an angle 617 of about −60° to −70° (see FIG. 17 for a positive angle of a ridge) and parallel to each other. The turbulator 600 also includes four ridges 602, 604, 606 and 608 that are oriented at an angle 617 of about 60° to 70°. Thus, each pair of adjacent ridges 601 and 602; 603 and 604; 605 and 606; and 606 and 608 is configured to resemble a V shape, a triangle or a similar shape.

The ridges 604 and 605 symmetrically straddle the centerline 127 and generally point toward the centerline 127. Accordingly, the ridges 604 and 605 can function as an alignment device to assist a player in generally aligning the ball with the centerline 127.

Each ridge 601-608 is shown to be a linear. However, each of the ridges 601-608 can be curved, have variable base width 613 along the length 611, have variable cross-sectional shapes, have variable height 615 along the length 611 and/or the base width 613, have sharp or blunt leading edges 610 or trailing edges 614, have sharp or blunt tops 612, have different surface textures, and/or have other physical variations along the length 611, the base width 613 and/or the height 615. The distance 609 may increase for each ridge 601-608 from the heel end 104 to the toe end 106 to approximately correspond with the location of the separation line 120 on the crown 110. However, as shown in FIGS. 21 and 22, each ridge 601-608 may be located at substantially the same distance 609 from the leading edge 112. Furthermore, each of the ridges 601-608 may be placed anywhere on the crown 110 to provide the boundary layer effects described herein. The location of the ridges may vary depending on the physical characteristics of the club head 100 and the airflow pattern on the crown 110. Each of the ridges 601-608 may be located along a straight line or a curvilinear line on the crown 110 between 0.25 inches (0.64 cm) and 4.5 inches (11.43 cm) from the club face 110. Each ridge 601-608 may have a height 615 that does not exceed 0.5 inches (1.27 cm). In one embodiment, at least one ridge 601-608 may have a height 615 that is greater than 0.02 inches (0.05 cm) but less than 0.2 inches (0.51 cm). The ridges 601-608 may have a distance 623 or 625 that contributes to the delay in airflow separation. The ridges 601-608 may be arranged on the crown 110 in a curvilinear manner based on the location of the separation region 120 of a particular club head 100. In one embodiment, the ridges 601-608 are located prior to the apex 111 of the crown 110 (highest point on the crown). Accordingly, the ridges 601-608 may be located between the leading edge 112 and the apex 111 of the crown 110.

Referring to FIG. 22, each ridge 601-608 trips the air flowing over the ridge to create small eddies or vortices along the length 611 for energizing the boundary layer downstream of the ridge 601-608 in an area 621 (shown only on ridge 604). Accordingly, the separation region 120 is moved farther aft on the crown 110. The distance 623 or 625 between each ridge 601-608, length 611, base width 613, height 615 and/or angle 617 may be configured so that the areas 621 slightly or greatly overlap, or do not overlap. The arrangement of the ridges 601-608 on the crown 110 as shown in of FIGS. 21 and 22 provides overlapping areas 621 of boundary layer turbulence. However, the ridges 601-608 can be configured to have any physical characteristics and spaced apart at any distance 623 or 625. For example, if the ridges have shorter lengths than the length 611 of the ridges 601-608 shown in FIGS. 21 and 22, the distance 623 or 625 can be reduced to ensure overlap of areas 621 downstream of the ridges 601-608. In another example, if the angles 617 of the ridges 601-608 relative to the club face 100 are different than the angle 617 shown in FIGS. 21 and 22, the distance 623 or 625 or the lengths 611 of the ridges 601-608 can be accordingly modified to ensure that areas 621 overlap downstream of the ridges 601-608. In yet another example, multiple rows of ridges can be provided on the crown 110 in tandem or offset relative to each other. Thus, any number of ridges with each ridge having any physical characteristic and distance 609 relative to an adjacent ridge can be provided on the crown 110. For example, in certain application, overlapping of the areas 621 may not be suitable. Accordingly, the ridges 601-608 can be configured to reduce minimize or prevent overlap of the areas 621.

The turbulator 400, 500 or 600 may be constructed from any type of material, such as stainless steel, aluminum, titanium, various other metals or metal alloys, composite materials, natural materials such as wood or stone or artificial materials such as plastic. If the turbulator 400, 500 or 600 is constructed from metal, it may be formed on the club head 100 or simultaneously with the club head 100 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 100 and/or the turbulator 400, 500 or 600. Molten metal or plastic material is injected into the mold, which is then cooled. The club head 100 and/or the turbulator 400, 500 or 600 is then removed from the mold and may be machined to smooth out irregularities on the surfaces thereof or to remove residual parts. If the turbulator 400, 500 or 600 is manufactured separate from the club head 100, the turbulator 400, 500 or 600 can be fixedly or removably attached to the crown 110 with fasteners, adhesive, welding, soldering, or other fastening methods and/or devices. In one example, the turbulator 400, 500 or 600 may be formed from metallic material. The turbulator 400, 500 or 600 can then be attached to the crown 110 with an adhesive. In another example, the turbulator 400 may include an elongated projection that slides into a correspondingly sized slot on the crown 110 to removably attached the turbulator 400, 500 or 600 to the crown 110. Thus, the turbulators 400, 500 or 600 may include removable connection mechanisms so that each turbulator 400, 500 or 600 can be selectively connected to or removed from the club head 100. The turbulators on the crown 110 are described above to be defined by ridges. However, any one or more of the turbulators may be defined by grooves formed in the crown 110. The turbulators may be formed by cutting grooves in the crown 110 by various methods such machining, laser cutting, or the like.

Figure 27:
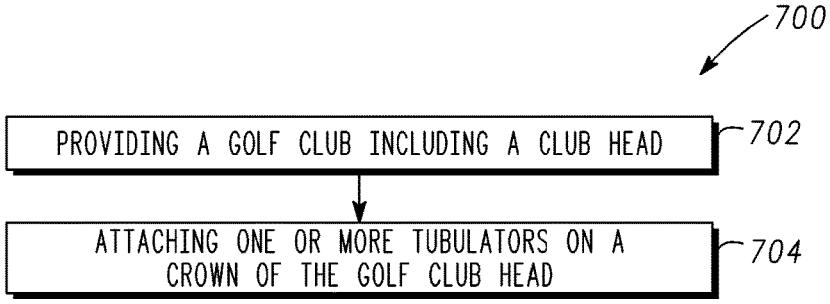
FIG. 27 is a flow chart showing a method of manufacturing a club head with turbulators according to one embodiment.
Figure 28:
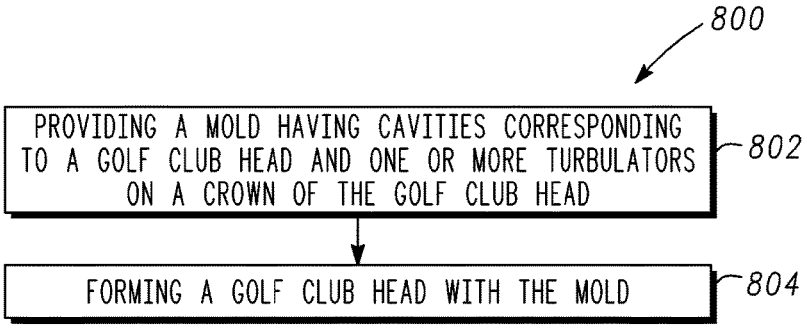
FIG. 28 is a flow chart showing a method of manufacturing a club head with turbulators according to another embodiment.

According to one example shown in FIG. 27, a method 700 of manufacturing a golf club head having turbulators according to various embodiments includes at 702 providing a golf club having a club head, and at 704, attaching one or more turbulators on a crown of the club head. According to another example shown in FIG. 28, a method 800 of manufacturing a golf club head having turbulators according to various embodiments includes at 802 providing a mold having cavities corresponding to a golf club head and one or more turbulators, and at 804, forming the club head and the turbulators with the mold.

Figure 29:
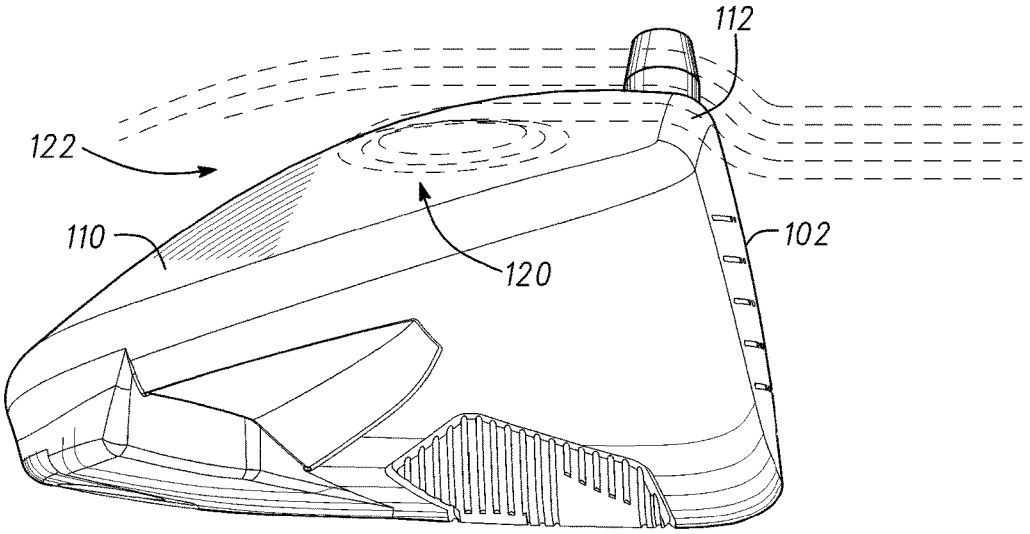
FIG. 29 shows a schematic view based on actual airflow visualization experiments of airflow over a club head without turbulators.
Figure 30:
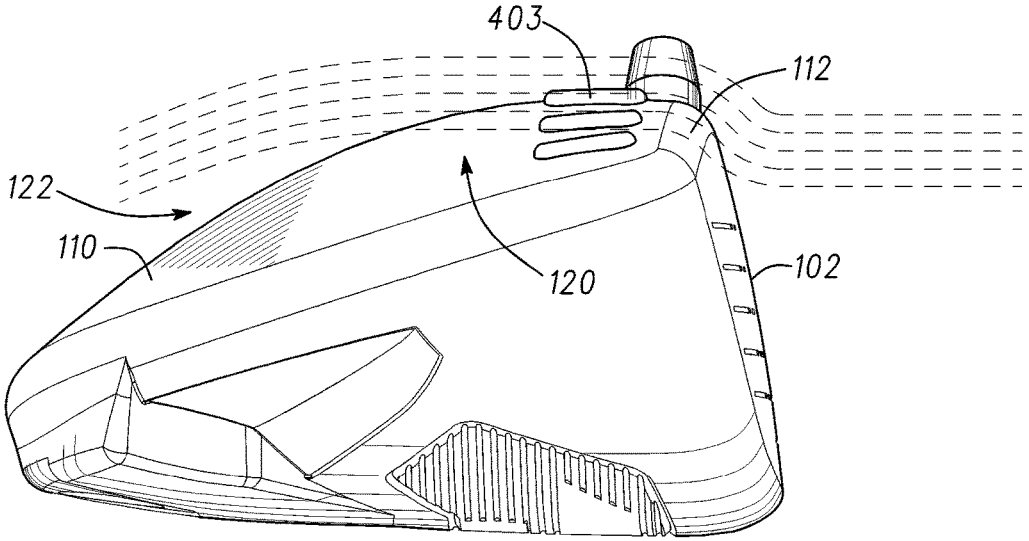
FIG. 30 shows a schematic view based on actual airflow visualization experiments of airflow over the club head of FIG. 29 with turbulators.

FIG. 29 shows a schematic view based on actual airflow visualization experiments of airflow over the club head 100 without turbulators, and FIG. 30 shows a schematic view based on actual airflow visualization experiments of airflow over the same club head with the turbulators 400. In FIG. 29, the streamlines representing airflow approach the club had 100 and are diverted over the club face toward the leading edge. The streamlines traverse over the leading edge 112 and flow over the crown 110. However, the airflow becomes detached from the crown 110 at the separation region 120, and creates a turbulent wake 122 over a substantial section of the crown 110. This turbulent wake 122 increases the drag thereby reducing the speed of the club head 100. Referring to FIG. 30, the ridges 401-408 are positioned downstream of the leading edge 112 and upstream of the separation region 120 of FIG. 29. Accordingly, the flow remains attached on a substantial portion of the crown 110 as is shown by the streamlines in FIG. 30. Therefore, the separation region 120 is moved farther aft on the crown 110.

As described above, any of the physical characteristics of the turbulators 400, 500 or 600; the locations thereof on the crown; and/or the orientations thereof relative to any part of the crown, the centerline 127 and/or the leading edge 112 may be configured to provide a particular boundary layer effect. According to one embodiment, the turbulators may be located a distance Q from the leading edge 112 according to the following relation:

$$Q>0.05DA$$

where DA is the distance from the leading edge 112 to the apex 111 of the crown (i.e., the highest point on the crown). According to another embodiment, the angle γ, which is the angle of each ridge relative to the leading edge 112 may follow the relation:

$$\gamma>\text{Loft}$$

where Loft is the loft angle of the club head 100. According to another embodiment, the distance P, which is the distance between each ridge, may follow the relation:

$$2L\cos(\gamma)>P>0.8L\cos(\gamma)$$

where L is the length of a ridge.

Tables 1 and 2 show experimental results for a golf club head 100 without any turbulators, with the turbulator 300, and with turbulators 400. Table 1 shows measured values of aerodynamic drag expressed in lbs for different orientation angles of the club head 100. The speed of the club head 100 is directly affected by the orientation angle. An increase in orientation angle results in an increase in the speed of the club head 100.

TABLE 1

Drag Force (lbs) vs. Orientation Angle (degrees)

| Angle (in degrees) | Without turbulators | Turbulator 300 | Turbulator 400 |
|---|---|---|---|
| 90 | 2.01496256 | 1.507344 | 1.495429 |
| 60 | 1.30344225 | 1.300062 | 1.293326 |
| 30 | 0.88754571 | 0.905306 | 0.898112 |
| 0 | 0.22323528 | 0.227507 | 0.235375 |

TABLE 2

Lift Force (lbs) vs. Orientation Angle (degrees)

| Angle (in degrees) | Without turbulators | Turbulator 300 | Turbulator 400 |
|---|---|---|---|
| 90 | −0.3884699 | 0.061148 | 0.092846 |
| 60 | 0.27763904 | 0.343283 | 0.189739 |
| 30 | 0.6006895 | 0.608558 | 0.560674 |
| 0 | 0.20772346 | 0.205925 | 0.225259 |

Figure 31:
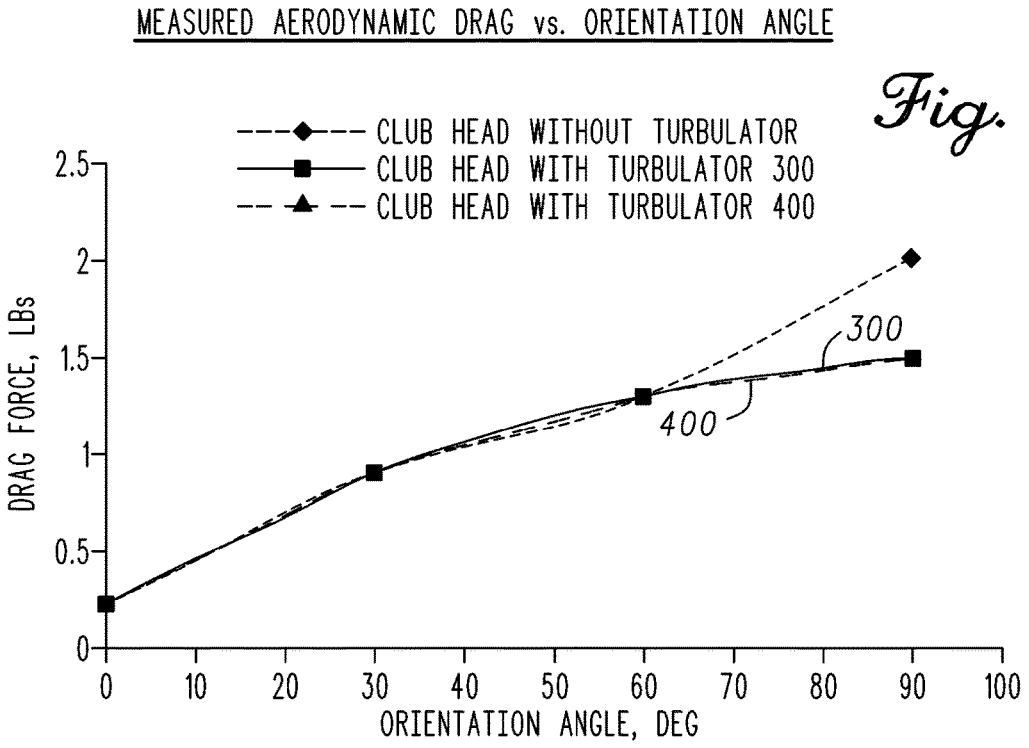
FIG. 31 is a graph showing measurements of drag force vs. orientation angle.

As shown in Table 1, when the club head 100 has an orientation angle of greater than 60°, the aerodynamic drag force on the club head 100 is reduced for the club head 100 having the turbulator 300 or the turbulators 400. The reduction in drag is much greater for an orientation angle of 90°. Referring to FIG. 31, which is a graphical representation of the data in Table 1, the noted reduction in drag for orientation angles of greater than 60° is visually shown. Furthermore, the turbulator 400 (including one or more ridges 401-408) is shown to reduce the drag force on the club head 100 more than the turbulator 300.

Figure 32:
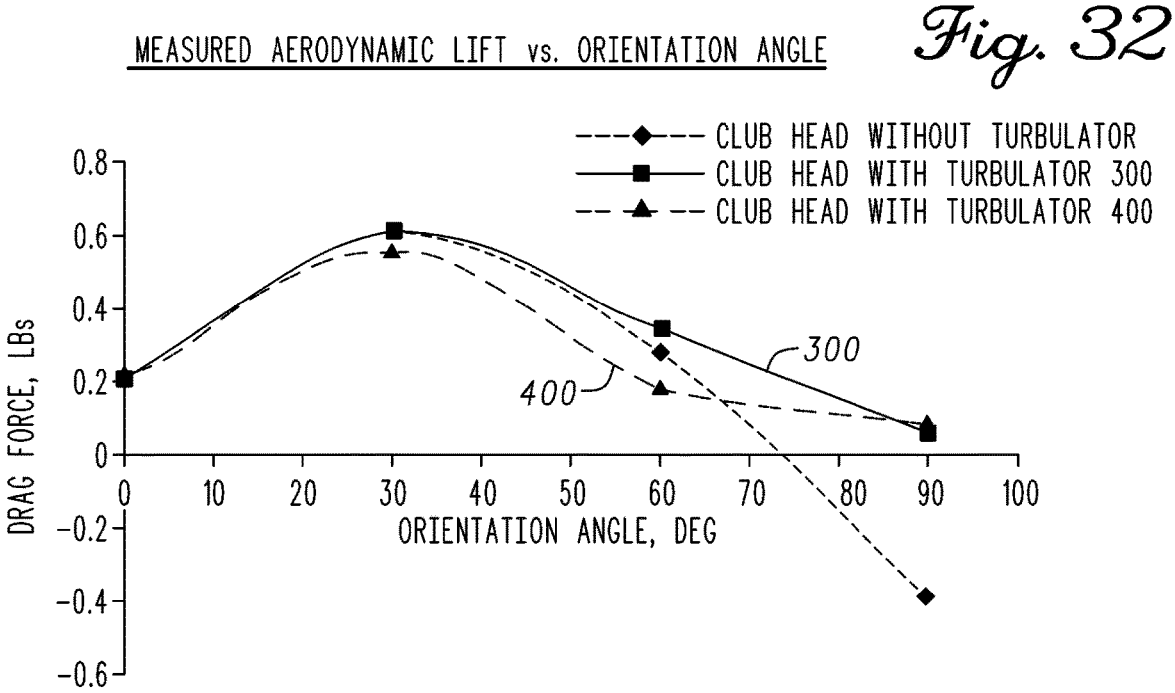
FIG. 32 is a graph showing measurements of lift force vs. orientation angle.

Table 2 shows measured values of lift expressed in lbs for different orientation angles of the club head. When the club head 100 has an orientation angle of greater than 60°, the lift generated by the club head does not drop as sharply for the club head 100 having the turbulator 300 or the turbulators 400 as compared to the club head 100 without any turbulators. Referring to FIG. 32, which is a graphical representation of the data in Table 2, the noted drop in lift for the club head 100 without any turbulators is visually shown. The noted drop in lift is due to the higher pressure differential caused by the earlier boundary layer separation on the crown for the club head 100 without any turbulators as compared to the club head 100 having turbulator 300 or turbulators 400. Thus, Tables 1 and 2 and FIGS. 31 and 32 illustrate the adverse effects of early boundary layer separation on the crown for a golf club head without any turbulators and the effects of delaying the boundary layer separation on drag forces exerted on a golf club head.

Figure 33:
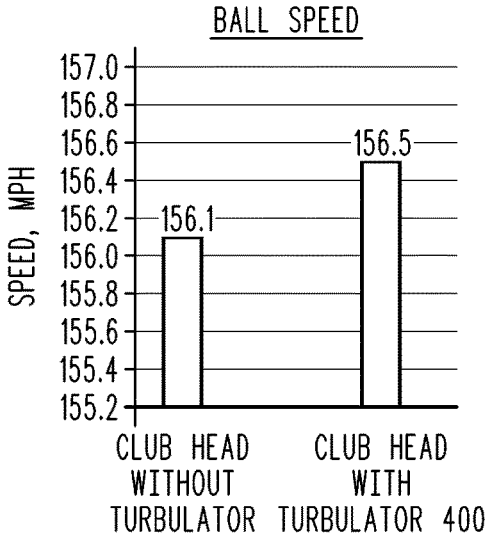
FIG. 33 is a graph showing measurements of ball speed.
Figure 34:
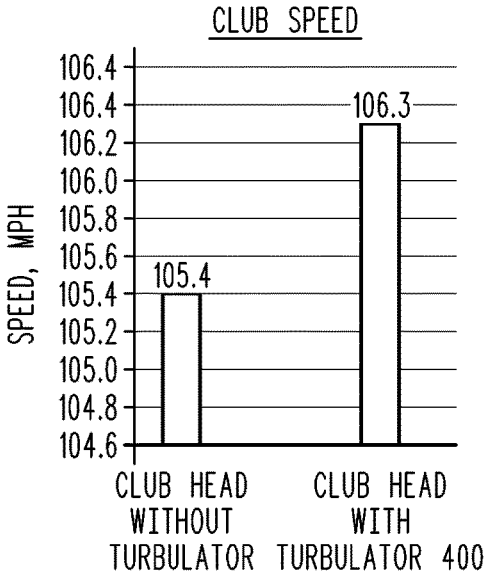
FIG. 34 is a graph showing measurements of club speed.
Figure 35:
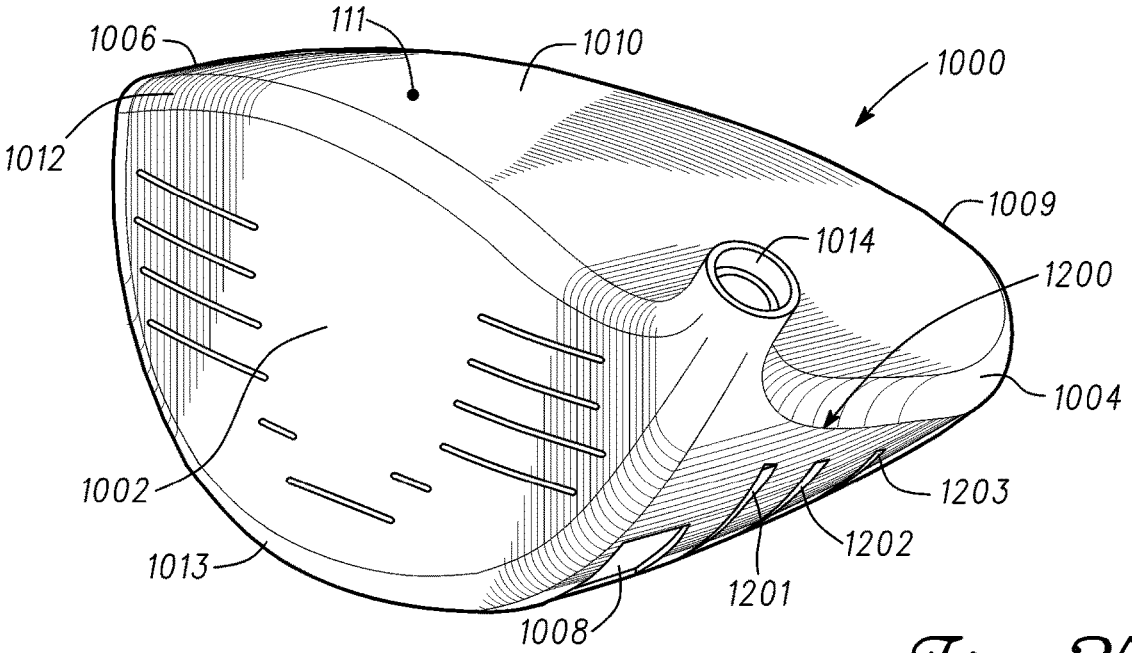
FIGS. 35-38 are different perspective views of a club head having sole turbulators according to one embodiment.

FIGS. 33 and 34 graphically show measured ball speed and club head speed for a golf club head without any turbulators and a golf club head having the turbulators 400. FIG. 33 shows that ball speed is higher when the golf club head includes the turbulators 400. This increase in ball speed is due to the higher club head speed as shown in FIG. 34 due to the turbulators 400 delaying boundary layer separation on the crown, thereby reducing drag forces on the club head.

Referring to FIGS. 35-38, another exemplary golf club head 1000 is shown, which includes a face 1002 that extends horizontally from a heel end 1004 to a toe end 1006 and vertically from a sole 1008 to a crown 1010. The heel end 1004 and the toe end 1006 extend from the face 1002 to the rear 1009 of the club head 1000. A transition region between the face 1002 and the crown 1010 defines an upper leading edge 1012 and a transition region between the face 1002 and the sole defines a lower leading edge 1013. The club head 1000 also include a hosel 1014 for receiving a shaft (not shown). The club head 1000 is shown to be a wood-type club head. However, the present disclosure is not limited to wood-type club heads and applies to any type of golf club head (e.g., a driver-type club head, a fairway wood-type club head, a hybrid-type club head, an iron-type club head, a wedge-type club head, or a putter-type club head).

Figure 36:
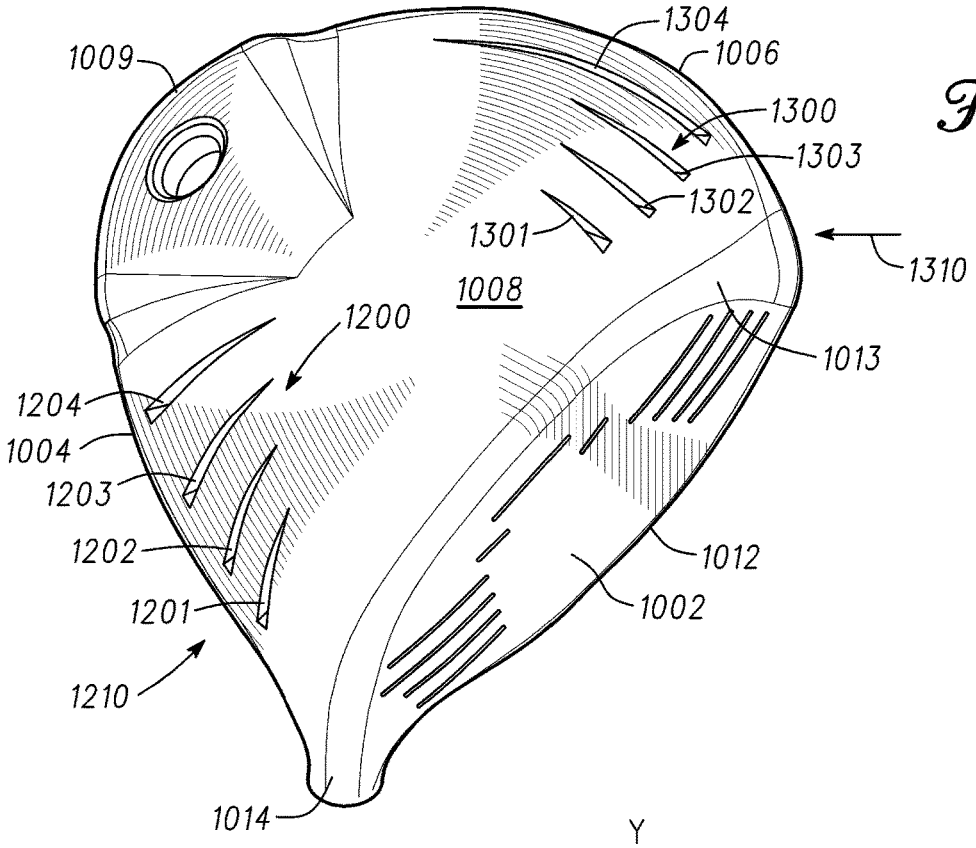
Figure 38:
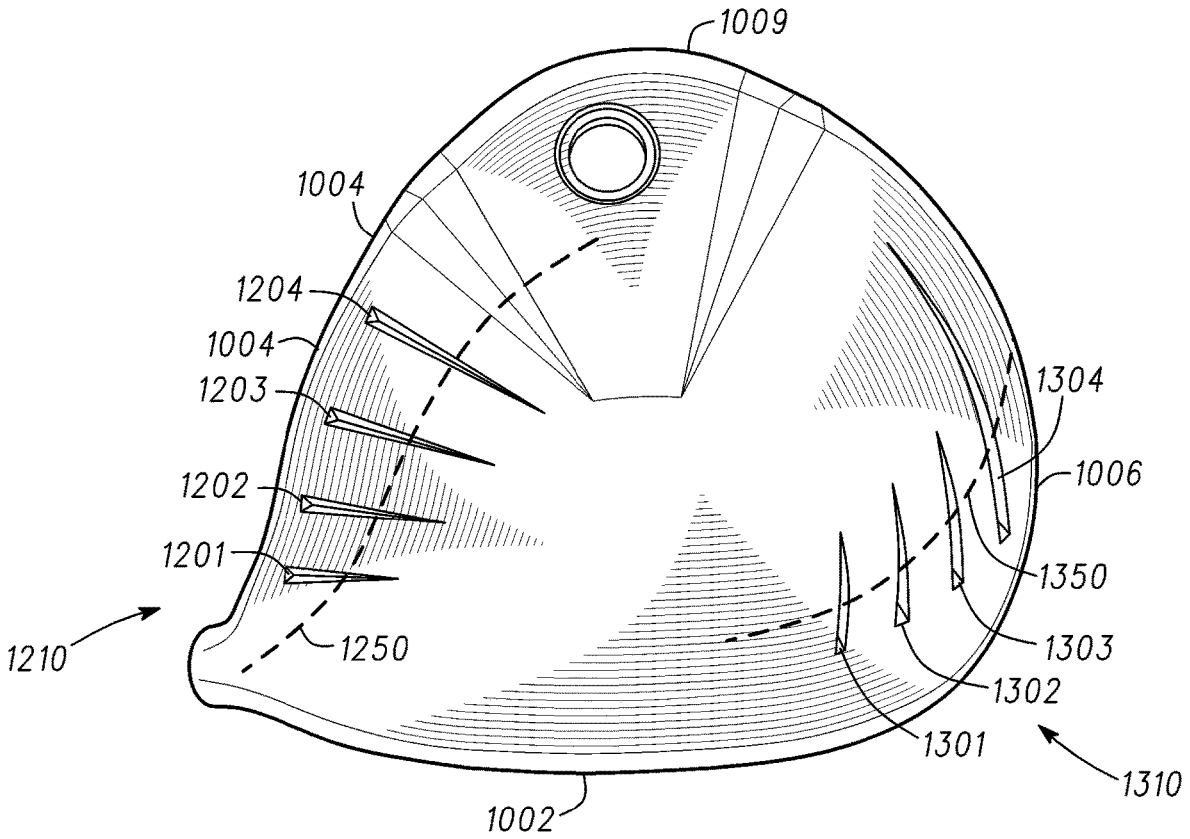

Club head 1000 includes a plurality of turbulators 1201-1204 and 1301-1304 on the sole 1008, which may be generally referred to herein as turbulators 1200 and 1300, respectively. The turbulators 1200 and 1300 energize the boundary layer on the sole 1008 during the downswing, the impact position, and the follow through phases of the golf swing. During the initial part of the downswing, the air that is upstream of the club head 1000 flows generally over the heel 1004 and onto the sole 1008 and the crown 1010. During the intermediate part of the downswing, the air flows generally over the transition area between the heel 1004 and the face 1002 and onto the sole 1008 and the crown 1010. During the final part of the downswing just prior to the impact position, the air flows generally over the face 1002 and onto the sole 1008 and the crown 1010. Arrow 1210 of FIGS. 36 and 38 represents one exemplary direction of airflow during the downswing part of the golf swing. The air flowing over the sole 1008 forms a boundary layer on the sole. The turbulators 1200 energize the boundary layer to delay detachment of the flow downstream of the turbulators 1200. Accordingly, the drag on the club head 1000 is reduced thereby increasing club speed during the downswing.

After the face 1002 strikes the ball in the impact position, the club head 1000 is rotated during the follow through. The air that is upstream of the club head 1000 flows generally over the face 1002 and onto the sole 1008 and the crown 1010 during the initial part of the follow through. During the intermediate part of the follow through, the air flows generally over the transition area between the toe 1006 and the face 1002 and onto the sole 1008 and the crown 1010. During the final part of the follow through, the air may flow generally over the toe 1006 and onto the sole 1008 and the crown 1010. As shown in FIGS. 36 and 38, arrow 1310 represents one exemplary direction of airflow during the follow through part of the golf swing.

Figure 37:
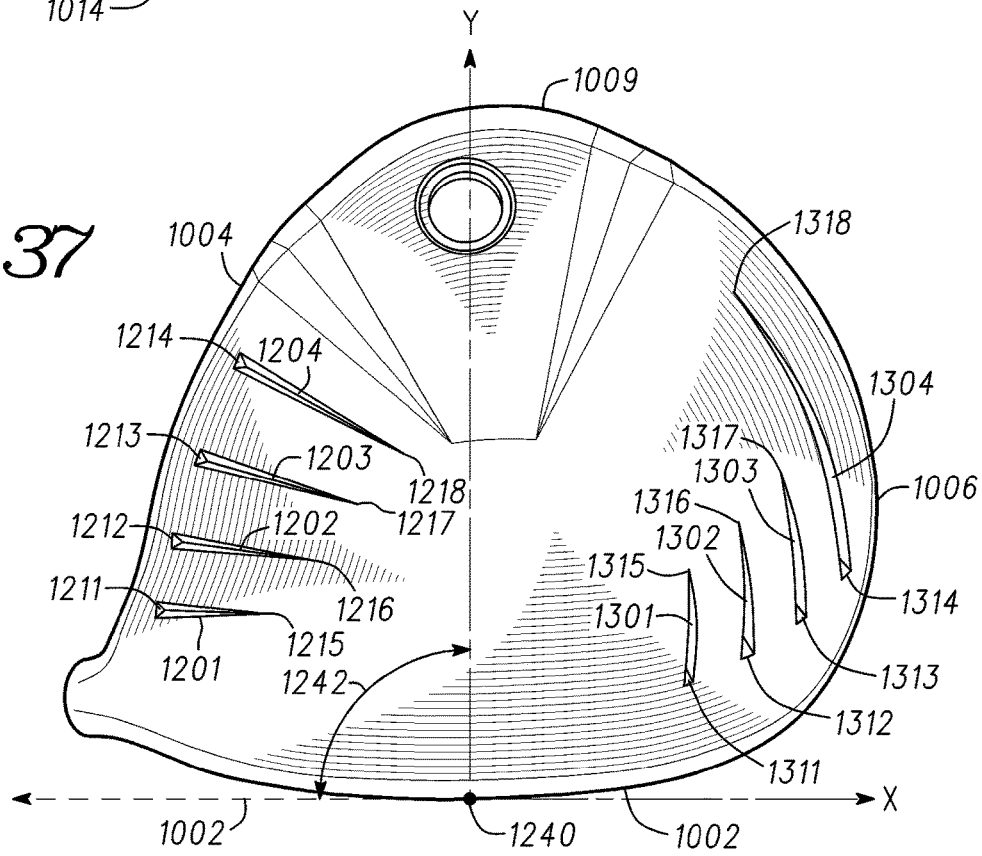

FIG. 37 shows x and y coordinate axes for describing the dimensions, locations on the sole 1008, and orientations relative to the face 1002 of the turbulators 1200 and 1300. The x and y coordinate axes have an origin 1240 (i.e., x=0, y=0), which may define a center point of the face 1002. Accordingly, the y axis may define a center line for the club head 1000. As described in detail below, the location of each turbulator 1200 and 1300 on the sole 1009 can be expressed by an x-location and a y-location. Furthermore, the orientations of the turbulators 1200 and 1300 can be expressed relative to the x axis by an angle 1242.

The turbulators 1201-1204 may be defined by grooves that generally extend from near the heel end 1004 in a direction toward the toe end 1006. Each turbulator 1201-1204 has a first end 1211-1214 and a second end 1215-1218, respectively. The first ends 1211-1214 are located near the heel end 1004 and may generally follow the contour of the heel end 1004. Accordingly, the first ends 1211-1214 of the turbulators 1201-1204 may have approximately the same distance from the heel end 1004. However, the first ends 1211-1214 may be located anywhere on the sole 1008 to delay airflow separation on the sole 1008.

The turbulators 1201-1204 may have the same dimensions and extend parallel to each other or may have different dimensions and extend non-parallel to each other. Depending on the position of the airflow separation region during the downswing, which is shown by example with line 1250 in FIG. 38, the configurations of the turbulators 1200 can be varied to energize the airflow upstream of the separation region 1250. For example, the turbulators 1201-1204 progressively increase in length in a direction from the face 1002 to the rear 1009. Accordingly, the second ends 1215-1218 are progressively nearer to the y axis. Thus, the progressive length increase of the turbulators 1201-1204 may follow the contour of the separation region 1250 so as to provide detached flow on the sole 1008 downstream of the turbulators 1201-1204. Similarly, the depth, the width and/or the angle 1242 of each turbulator 1201-1204 may be varied to provide a particular flow pattern. As shown in FIG. 37, the angle 1242 progressively increases in a direction from the face 1002 to the rear 1009. The angle 1242 for each turbulator 1201-1204 may correspond with a particular rotational position of the club head 1000 during the downswing. Accordingly, by varying the angle 1242 in the direction from the face 1002 to the rear 1009, the turbulators 1201-1204 may energize the flow upstream of the separation region S1 for generally all rotation angles of the club head 1000 during the downswing. The angle 1242 may be measured between any reference line on a turbulator and the x or y axis. In the disclosure, the angle 1242 is measured as the angle between the x-axis and a line connecting the ends of a turbulator.

The grooves defining the turbulators 1201-1204 may be wider at the first ends 1211-1214 and narrower at the second ends 1215-1218, respectively. The depth of the grooves may also gradually decrease from the first ends 1211-1214 to the second ends 1215-1218, respectively. The grooves may be formed in any shape on the sole 1008. For example, the grooves can be narrow at the first ends 1211-1214 and the second ends 1215-1218 and then gradually or abruptly widen toward the centers of the grooves 1201-1204. In contrast, the grooves can be wider at the first ends 1211-1214 and the second ends 1215-1218 and then gradually or abruptly narrow toward the centers of the grooves 1201-1204. The depth of the grooves may also vary in any manner, such as according to the variation in width of the grooves.

The width, length, depth, location (i.e., x and y location), angle 1242, and the shapes of the grooves that define the turbulators 1200 can be varied from the face 1002 to the rear 1009 to provide a particular flow pattern for generally all rotation angles of the club head 1000 during the downswing. Furthermore, the number of turbulators 1200 can also be varied to provide a particular flow pattern on the sole 1008. For example, five, six or more turbulators 1200 can be provided on the sole 1008. The turbulators 1200 may be located on the sole 1008 adjacent to each in a direction from the face 1002 to the rear 1009, and/or may be in tandem.

Table 3 below shows exemplary configurations for the turbulators 1201-1204. The x and y locations refer to the x and y locations of the second ends 1215-1218. All of dimensions in Table 3 are expressed in inches. Furthermore, the depth and width of the grooves defining the turbulators 1201-1204 are measured at the first ends 1211-1214 of the turbulators 1201-1204, respectively. Table 3 represents only an example of the turbulators 1201-1204 and in no way limits the properties of the turbulators 1200.

TABLE 3

| Turbulator | Depth | Length | Width | Location-X | Location-Y | Angle 1242° |
|---|---|---|---|---|---|---|
| 1201 | 0.063 | 1.14 | 0.11 | −1.31 | 1.28 | 2.95 |
| 1202 | 0.065 | 1.28 | 0.11 | −1.01 | 1.67 | 7.97 |
| 1203 | 0.066 | 1.41 | 0.11 | −0.68 | 2.05 | 16.98 |
| 1204 | 0.067 | 1.52 | 0.11 | −0.35 | 2.39 | 30 |

The turbulators 1301-1304 may be defined by grooves that generally extend from near a portion of the face that is close to the toe end 1006 toward the rear 1009. The grooves may also extend generally from near a transition area between the face 1002 and the toe end 1006 toward the rear 1009. Additionally, the grooves may extend from near the toe end 1006 toward the rear 1009. Each turbulator 1301-1304 has a first end 1311-1314 and a second end 1315-1318, respectively. The first ends 1311-1314 are located near the face 1002 or the toe end 1006 and may either extend in a direction from the face 1002 toward the rear 1009 or generally follow the contour of the toe end 1006. However, the first ends 1311-1314 may be located anywhere on the sole 1008 to delay airflow separation on the sole 1008.

The turbulators 1301-1304 may have the same dimensions and extend parallel to each other or may have different dimensions and extend non-parallel to each other. Depending on the position of the airflow separation region, which is shown by example with line 1350 in FIG. 38, the dimensional characteristics of the turbulators 1300 can be varied to energize the airflow upstream of the separation region 1350. For example, the turbulators 1301-1304 progressively increase in length in a direction from the face 1002 toward the toe end 1006 and from the toe end 1006 toward the rear 1009. Accordingly, the second ends 1315-1318 are progressively farther from the x axis and the y-axis. The progressive length increase of the turbulators 1301-1304 may follow the contour of the separation region 1350 to provide attached airflow downstream of the turbulators 1301-1304. Similarly, the depth, the width and/or the angle 1242 of each turbulator 1301-1304 may vary to provide a particular flow pattern. As shown in FIG. 37, the angle 1242 progressively decreases in a direction from the face 1002 toward the toe end 1006 and from the toe end toward the rear 1009. The angle 1242 for each turbulator 1301-1304 may correspond with a particular rotational position of the club head 1000 during follow through. Accordingly, by varying the angle 1242 in the direction from the face 1002 toward the toe end 1006 and from the toe end 1006 toward the rear 1009, the turbulators 1301-1304 may energize the flow upstream of the separation region 1350 for generally all rotation angles of the club head 100 during follow through. Further, each of the turbulators 1301-1304 may have a curvature that generally corresponds to the curvature of the toe end 1006, and may represent the general direction of airflow over the sole 1008 during impact position and follow through. The angle 1242 may be measured between any reference line on a turbulator and the x or y axis. In the disclosure, the angle 1242 is measured as the angle between the x-axis and a line connecting the ends of a turbulator.

The grooves defining the turbulators 1301-1304 may be wider at the first ends 1311-1314 and narrower at the second ends 1315-1318, respectively. The depth of the grooves may also gradually decrease from the first ends 1311-1314 to the second ends 1315-1318, respectively. The grooves may be formed in any shape on the sole 1008. For example, the grooves can be narrow at the first ends 1311-1314 and the second ends 1315-1318 and then gradually or abruptly widen toward the centers of the grooves 1301-1304. In contrast, the grooves can be wider at the first ends 1311-1314 and the second ends 1315-1318 and then gradually or abruptly narrow toward the centers of the grooves 1301-1304. The depth of the grooves may also vary in any manner, such as according to the variation in width of the grooves.

The width, length, depth, location (i.e., x and y location), angle 1242, and the shapes of the grooves defining the turbulators 1300 can be varied from the face 1002 toward the toe end 1006 and from the toe end 1006 toward the rear 1009 to provide a particular flow pattern for generally all rotation angles of the club head 1000 during follow through. Furthermore, the number of turbulators 1300 can also be varied to provide a particular flow pattern on the sole 1008. For example, five, six or more turbulators 1300 can be provided on the sole 1008. The turbulators 1300 may be located on the sole 1008 adjacent to each other and/or in tandem.

Table 4 below shows exemplary configurations for the turbulators 1301-1304. The x and y locations refer to the x and y locations of the second ends 1315-1318. All of the dimensions shown in Table 4 are expressed in inches. Furthermore, the depth and width of the grooves defining the turbulators 1301-1304 are measured at the first ends 1311-1314 of the turbulators 1301-1304, respectively. Table 3 is only an exemplary configuration of the grooves 1301-1304 and in no way limits the properties of the turbulators 1300.

TABLE 4

| Turbulator | Depth | Length | Width | Location-X | Location-Y | Angle 1242° |
|---|---|---|---|---|---|---|
| 1301 | 0.05 | 0.80 | 0.12 | 1.60 | 1.60 | 90.09 |
| 1302 | 0.06 | 0.97 | 0.12 | 1.94 | 1.93 | 86.56 |
| 1303 | 0.07 | 1.09 | 0.12 | 2.24 | 2.27 | 83.03 |
| 1304 | 0.08 | 2.29 | 0.12 | 1.91 | 3.54 | 69.02 |

The turbulator 1200 and 1300 are described above to be defined by grooves in the sole 1008. Accordingly, the turbulators 1200 and 1300 may be formed on the golf club 1000 by cutting the grooves into the sole 1008 of the golf club 1000 by various methods such machining, laser cutting, or the like. Alternatively, any one or more of the turbulators 1200 and/or the turbulators 1300 may be defined by ridges or projections on the sole 1008. Such grooves or ridges may be formed simultaneously with the club head 1000 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 1000 and/or the turbulators 1200 and 1300. Molten metal or plastic material is injected into the mold, which is then cooled. The club head 1000 and/or the turbulators 1200 and 1300 is then removed from the mold and may be machined to smooth out irregularities on the surfaces thereof or to remove residual parts. If the turbulators 1200 and 1300 are in the form of ridges and are to be be manufactured separately from the club head 1000, the turbulator 300 can be fixedly or removably attached to the sole 1008 with fasteners, adhesive, welding, soldering, or other fastening methods and/or devices. In one example, the turbulator 1200 or 1300 may be formed from a strip of material having an adhesive backing. Accordingly, the turbulators 1200 and 1300 may be attached to the club head 1000 at any location on the sole 1008 with the adhesive backing.

Figure 39:
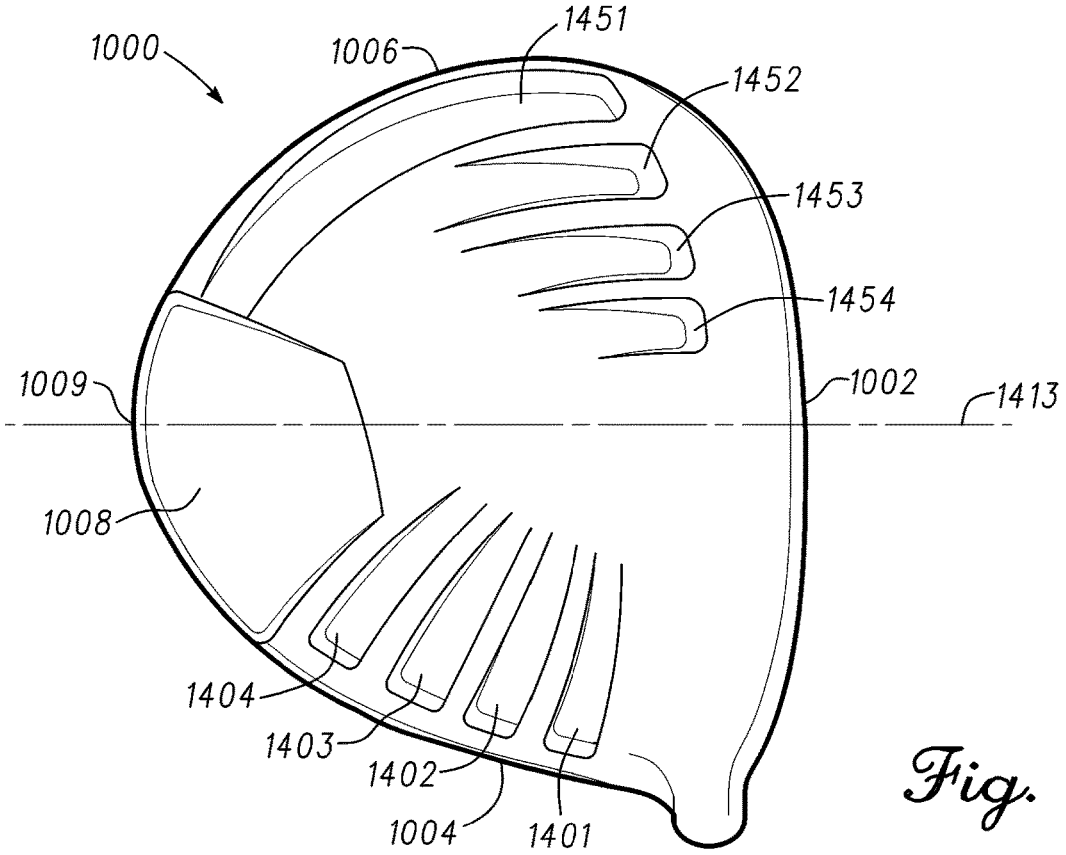
FIG. 39 is a perspective bottom view of a club head having sole turbulators according to one embodiment.

FIG. 39 shows grooves 1401-1404 and 1451-1454 on the sole 1008 of the golf club 1000 according to another embodiment. The grooves 1401-1404 and 1451-1454 may be generally referred to herein as grooves 1400 and 1500, respectively. The grooves 1401-1404 may be located between the centerline 1413 and the heel end 1006 and generally extend from the heel end 1004 toward the face 1002 or toward a region between the toe end 1006 and the face 1002. The centerline 1413 may be defined by a line that extends from a center portion of the face 1002 to the rear 1009 and may generally define a center line of the golf club head. The grooves 1451-1454 may generally extend from near a portion of the sole 1008 that is close to the toe end 1006 toward the rear 1009. The grooves 1451-1454 may also or alternatively extend from near a region between the face 1002 and the toe end 1006 toward the rear 1009. The grooves 1401-1404 and 1451-1454 are formed on the surface of the sole 1008 and may appear as depressions on the surface of the sole 1008.

The grooves 1401-1404 may be arranged adjacent to each other on the sole 1008 along the contour of the heel end 1004. The grooves 1401-1404 may have the same dimensions and extend parallel to each other or may have different dimensions and extend non-parallel to each other. For example, the grooves 1401-1404 are shown in FIG. 39 to progressively increase in length in a direction from the face 1002 to the rear 1009. Each of the grooves 1451-1454 may either extend in a direction from the face 1002 toward the rear 1009 and/or generally follow the contour of the toe end 1006. The grooves 1451-1454 may have the same dimensions and extend parallel to each other or may have different dimensions and extend non-parallel to each other. For example, the grooves 1451-1454 may progressively decrease in length in a direction from the toe end 1006 to the heel end 1004. The grooves 1400 and 1500 may be constructed with similar methods as the disclosed methods for constructing the turbulators 1200 and 1300. Accordingly, a detailed description of methods of manufacturing the grooves 1400 and 1500 is not described for brevity. The grooves 1401-1404 and 1451-1454 may have any shape and/or configuration and are not limited in configuration to the grooves described herein.

Increasing the size of a golf club head may provide a larger golf club face for better face response, allow the center of gravity of the golf club to be lowered and/or moved rearward, and/or allow the moment of inertia of the golf club to be optimized. However, the size of a golf club head may be limited to a particular size. For example, a golf governing body may limit a head of a driver-type golf club to a certain volume, such as 460 cubic centimeters. To increase the size of a golf club head without exceeding a certain volume limitation, the depth, width, length and other characteristics of the grooves 1401-1404 and 1451-1454 may be determined so that a reduction in volume of the club head as a result of providing the grooves is used to increase the size of the club head. For example, if the volume of a golf club head is limited to 460 cubic centimeters, the grooves 1401-1404 and 1451-1454 may be formed to provide a volume reduction of about 20 cubic centimeters in the golf club head. In other words, the volume defined by the grooves 1401-1404 and 1451-1454 may be about 20 cubic centimeters. Accordingly, the golf club head may be constructed to be as large as a golf club head having a volume of 480 cubic centimeters, yet have a volume of 460 cubic centimeters by having the grooves 1401-1404 and 1451-1505. Thus, the grooves 1401-1404 and 1451-1454, or any grooves formed on a golf club head as described herein, allow a golf club head to be made larger without exceeding a certain volume limitation. According to another example, a golf club head may be constructed having a volume of 478 cubic centimeters. By forming the grooves 1401-1404 to define a volume of 4 cubic centimeters and the grooves 1451-1454 to define a volume of 6 cubic centimeters, the volume of the golf club head may be reduced to 468 cubic centimeters and yet have generally the same size as a club head having a volume of 478 cubic centimeters.

Figure 40:
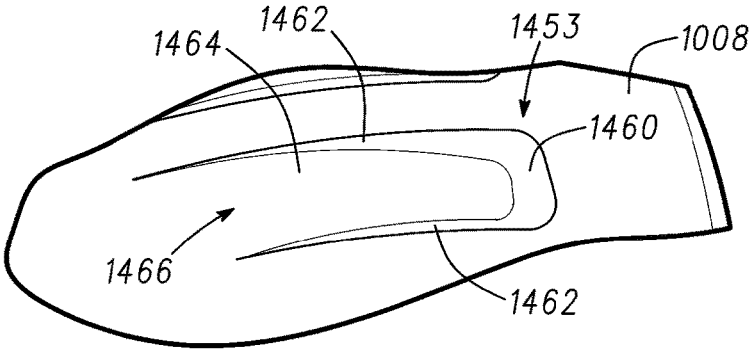
FIG. 40 is a perspective view of a portion of the club head of FIG. 39.

FIG. 40 shows an enlarged view of the groove 1453 to illustrate an exemplary shape of the grooves 1401-1404 and 1451-1454. However, the grooves 1410-1404 and 1451-1454 may be in any configuration. Each groove 1401-1404 and 1451-1454 is defined by an end wall 1460, two side walls 1462 and a bottom 1464. The side walls 1462 diminish in height from the end wall 1460 to a groove tail portion 1466, at which the bottom 1464 transitions to the surface of the sole 1008 of the golf club. Accordingly, the depth of each groove increases from the groove tail portion 1466 to the end wall 1460. The bottom 1464 may have the same width along the length of the groove as shown in the example of FIG. 39. The side walls 1462 may be perpendicular to the bottom 1464 and the end wall 1460. Alternatively, the side walls 1462 may be non-perpendicular relative to the bottom 1464 and the end wall 1460. The side walls 1462 may have similar or dissimilar lengths or depths. The end wall 1460, the side walls 1462 and the bottom 1464 may have any configuration so that a certain groove shape defining a certain volume is provided.

The grooves 1401-1404 and 1451-1454 may increase the rigidity or stiffness of the sole 1008 of a golf club head by functioning as reinforcing ribs. The increased rigidity may be provided by the shape of the grooves as defined by the angled connections between the end wall 1460, the side walls 1462 and the bottom 1464. The increased rigidity of the sole 1008 of a golf club head may prevent denting of the golf club head due to impact with a golf ball, possible impact with the ground, possible impact with an object other than a golf ball, and/or repeated use. Furthermore, the increased rigidity of the sole 1008 may allow the sole 1008 of a golf club head to be constructed with a reduced thickness to reduce the weight of a golf club head without affecting the structural integrity of the golf club head. Changing the thickness of the sole 1008 of a golf club may also affect the sound characteristics of the golf club. For example, the thickness of the sole 1008 may directly affect the frequency and/or the amplitude of the sound wave produced by a golf club head when impacting a ball. A thinner sole 1008 may produce a lower frequency sound, i.e., lower pitch, while a thicker sole 1008 may produce a higher frequency sound, i.e., higher pitch. Accordingly, by providing the grooves 1401-1404, 1451-1454 and/or any of the disclosed grooves on a golf club head, the thickness of the sole 1008 or other portions of the golf club head may be determined so that a certain sound is produced by the golf club head when impacting a golf ball.

The grooves 1401-1404 and/or the grooves 1451-1454 may be configured to provide certain sound characteristics for a golf club head. Changing the width, length and/or depth profile characteristics of one or more of the grooves and/or changing the distance between each groove may change the frequency and/or amplitude of the sound waves produced when the golf club head strikes a golf ball. For example, a plurality of deep and/or wide grooves may produce a lower frequency sound while a plurality of shallow and/or narrow grooves may produce a high frequency sound. In another example, placing the grooves closer together may produce a higher frequency sound while placing the grooves farther apart may produce lower frequency sound. Accordingly, the grooves 1401-1404, 1451-1454 and/or any of the disclosed grooves on a golf club head can be configured so that a certain sound is produced by the golf club head when impacting a golf ball.

Figure 41:
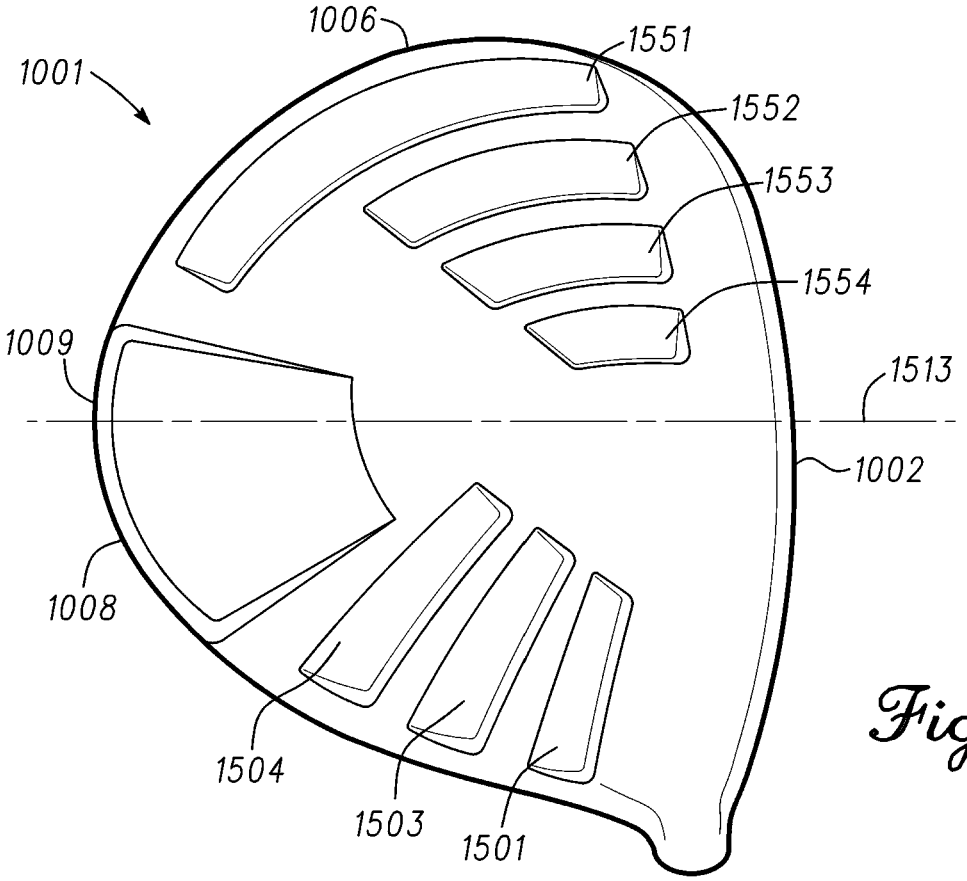
FIG. 41 is a perspective bottom view of a club head having sole turbulators according to one embodiment.

FIG. 41 shows grooves 1501-1503 and 1551-1554 on the sole 1008 of the golf club 1001 according to another embodiment. The grooves 1501-1503 may be located between the centerline 1513 and the heel end 1006 and generally extend from the heel end 1004 toward the face 1002 or toward a region between the toe end 1006 and the face 1002. The centerline 1513 may be defined by a line that extends from a center portion of the face 1002 to the rear 1009 and may generally define a center line of the golf club head. The grooves 1551-1554 may generally extend from near a portion of the sole 1008 that is close to the toe end 1006 toward the rear 1009. The grooves 1551-1554 may also or alternatively extend from near a region between the face 1002 and the toe end 1006 toward the rear 1009. The grooves 1501-1503 and 1551-1554 are formed on the surface of the sole 1008 and may appear as depressions on the surface of the sole 1008.

The grooves 1501-1503 may be arranged adjacent to each other on the sole 1008 along the contour of the heel end 1004. The grooves 1501-1503 may have the same dimensions and extend parallel to each other or may have different dimensions and extend non-parallel to each other. For example, the grooves 1501-1503 are shown in FIG. 41 to progressively increase in length in a direction from the face 1002 to the rear 1009. Each of the grooves 1551-1554 may either extend in a direction from the face 1002 toward the rear 1009 and/or generally follow the contour of the toe end 1006. The grooves 1551-1554 may have the same dimensions and extend parallel to each other or may have different dimensions and extend non-parallel to each other. For example, the grooves 1551-1554 may progressively decrease in length in a direction from the toe end 1006 to the heel end 1004. The grooves 1501-1503 and 1551-1554 may be constructed with similar methods as the disclosed methods for constructing the turbulators 1200 and 1300. Accordingly, a detailed description of methods of manufacturing the grooves 1501-1503 and 1551-1554 is not described for brevity. The grooves 1501-1503 and 1551-1554 may have any shape and/or configuration and are not limited in configuration to the grooves described herein.

Increasing the size of a golf club head may provide a larger golf club face for better face response, allow the center of gravity of the golf club to be lowered and/or moved rearward, and/or allow the moment of inertia of the golf club to be optimized. However, the size of a golf club head may be limited to a particular size. For example, a golf governing body may limit a head of a driver-type golf club to a certain volume, such as 460 cubic centimeters. To increase the size of a golf club head without exceeding a certain volume limitation, the depth, width, length and other characteristics of the grooves 1501-1503 and 1551-1554 may be determined so that a reduction in volume of the club head as a result of providing the grooves is used to increase the size of the club head. For example, if the volume of a golf club head is limited to 460 cubic centimeters, the grooves 1501-1503 and 1551-1554 may be formed to provide a volume reduction of about 20 cubic centimeters in the golf club head. In other words, the volume defined by the grooves 1501-1503 and 1551-1554 may be about 20 cubic centimeters. Accordingly, the golf club head may be constructed to be as large as a golf club head having a volume of 480 cubic centimeters, yet have a volume of 460 cubic centimeters by having the grooves 1501-1503 and 1551-1554. Thus, the grooves 1501-1503 and 1551-1554, or any grooves formed on a golf club head as described herein, allow a golf club head to be made larger without exceeding a certain volume limitation. According to another example, a golf club head may be constructed having a volume of 478 cubic centimeters. By forming the grooves 1501-1503 to define a volume of 4 cubic centimeters and the grooves 1551-1554 to define a volume of 6 cubic centimeters, the volume of the golf club head may be reduced to 468 cubic centimeters and yet have generally the same size as a club head having a volume of 478 cubic centimeters.

Figure 42:
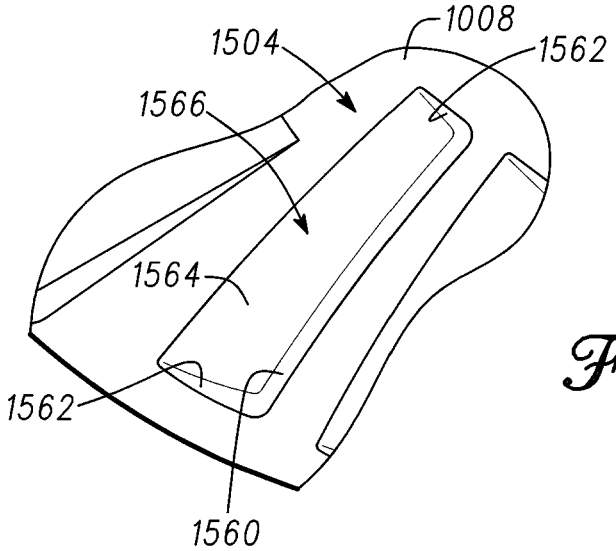
FIG. 42 is a perspective view of a portion of the club head of FIG. 41.

FIG. 42 shows an enlarged view of the groove 1504 to illustrate an exemplary shape of the grooves 1501-1503 and 1551-1554. However, the grooves 1501-1503 and 1551-1554 may be in any configuration. Each groove 1501-1503 and 1551-1554 is defined by an end wall 1560, two side walls 1562 and a bottom 1564. The side walls 1562 diminish in height from the end wall 1560 to a groove side portion 1566, at which the bottom 1564 transitions to the surface of the sole 1008 of the golf club. Accordingly, the depth of each groove increases from the groove side portion 1566 to the end wall 1560. The bottom 1564 may have generally the same width or slightly varying width along the length of the groove as shown in the example of FIG. 42. The side walls 1562 may be perpendicular to the bottom 1564 and the end wall 1560. Alternatively, the side walls 1562 may be non-perpendicular relative to the bottom 1564 and the end wall 1560. The side walls 1562 may have similar or dissimilar lengths or depths. The end wall 1560, the side walls 1562 and the bottom 1564 may have any configuration so that a certain groove shape defining a certain volume is provided. In contrast to the grooves 1401-1404 and 1451-1454, which diminish in depth along the length of the grooves, the grooves 1501-1503 and 1551-1554 diminish in depth along the width of the grooves.

The grooves 1501-1503 and 1551-1554 may increase the rigidity or stiffness of the sole 1008 of a golf club head by functioning as reinforcing ribs. The increased rigidity may be provided by the shape of the grooves as defined by the angled connections between the end wall 1560, the side walls 1562 and the bottom 1564. The increased rigidity of the sole 1008 of a golf club head may prevent denting of the golf club head due to impact with a golf ball, possible impact with the ground, possible impact with an object other than a golf ball, and/or repeated use. Furthermore, the increased rigidity of the sole 1008 may allow the sole 1008 of a golf club head to be constructed with a reduced thickness to reduce the weight of a golf club head without affecting the structural integrity of the golf club head. Changing the thickness of the sole 1008 of a golf club may also affect the sound characteristics of the golf club. For example, the thickness of the sole 1008 may directly affect the frequency and/or the amplitude of the sound wave produced by a golf club head when impacting a ball. A thinner sole 1008 may produce a lower frequency sound, i.e., lower pitch, while a thicker sole 1008 may produce a higher frequency sound, i.e., higher pitch. Accordingly, by providing the grooves 1501-1503 and 1551-1554 and/or any of the disclosed grooves on a golf club head, the thickness of the sole 1008 or other portions of the golf club head may be determined so that a certain sound is produced by the golf club head when impacting a golf ball.

The grooves 1501-1503 and/or the grooves 1551-1554 may be configured to provide certain sound characteristics for a golf club head. Changing the width, length and/or depth profile characteristics of one or more of the grooves and/or changing the distance between each groove may change the frequency and/or amplitude of the sound waves produced when the golf club head strikes a golf ball. For example, a plurality of deep and/or wide grooves may produce a lower frequency sound while a plurality of shallow and/or narrow grooves may produce a high frequency sound. In another example, placing the grooves closer together may produce a higher frequency sound while placing the grooves farther apart may produce lower frequency sound. Accordingly, the grooves 1501-1503, 1551-1554 and/or any of the disclosed grooves on a golf club head can be configured so that a certain sound is produced by the golf club head when impacting a golf ball.

Referring to FIGS. 43 and 44, a golf club head having a plurality of crown turbulators 1600 (e.g., two or more turbulators) according to another example is shown. The golf club head shown in FIGS. 43 and 44 is similar in many respects to the golf club head 100 of FIGS. 9 and 10. Accordingly, except for the turbulators 1600, same parts of the golf club head of FIGS. 43 and 44 and the golf club head 100 of FIGS. 9 and 10 are referred to with the same reference numbers. The turbulators 1600 may be defined by a plurality of ridges 1601-1606 that are positioned at or near the leading edge 112 and extend toward the separation region 120 or toward the rear 109 of the golf club head 100. The ridges 1601-1606 may also be referred to herein as turbulators 1601-1606. The ridges 1601-1606 may extend into the separation region 120. While FIGS. 43 and 44 may depict a particular configuration and number of ridges, the apparatus, methods and articles of manufacture described herein may include different configuration and/or more or less number of ridges.

Figure 45:
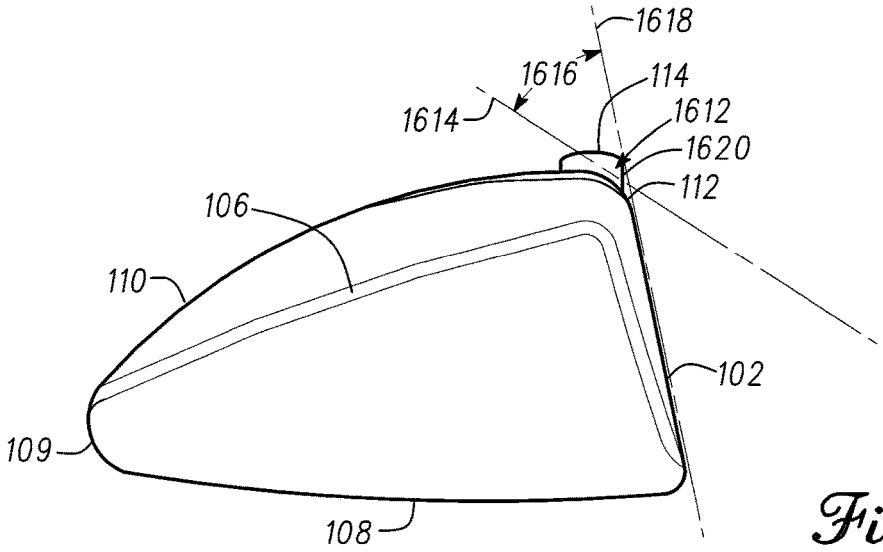
FIG. 45 is a side perspective view of a club head having turbulators according to one embodiment.

Referring also to FIG. 45, any one or all of the ridges 1601-1606 may be positioned on the crown 110 as close as possible to the leading edge 112 or at least partly on the leading edge 112 such that a leading edge portion 1612 of each of the ridges 1601-1606 does not extend beyond a leading edge plane 1614. The leading edge plane 1614 may be defined as a plane that is tangent to a portion of the leading edge 112 of the golf club head 100 or a location on the golf club head 100 where the crown 110 meets the club face 102. The leading edge plane 1614 defines a leading edge angle 1616 relative to a loft plane 1618. The loft plane 1618 may be a plane that defines or is tangent to a geometric center of the club face 102. Any one or all of the ridges 1701-1706 may be at least partly located on the leading edge 112 and extend beyond the leading edge plane 1614 (i.e., at least partly located between the leading edge plane 1614 and the loft plane 1618). The leading edge angle 1616 may range from 0°, which corresponds to the angle of the loft plane 1618, to any angle greater than 0°. For example, the leading edge angle 1616 may be greater than or equal to 30° but less than or equal to 90°, greater than or equal to 45° but less than or equal to 90°, greater than or equal to 60° but less than or equal to 90°, or greater than 75° but less than or equal to 90°.

Each of the ridges 1601-1606 may have any length, width, height and/or cross-sectional profile, such as any profile as described herein. As described above, each ridge 1601-1606 may be positioned at or near the leading edge 112 and may extend toward the separation region 120 or toward the rear 109 of the golf club head. In the example of FIGS. 43 and 44, each ridge 1601-1606 extends from the leading edge 112 toward the rear 109 of the golf club head 100 with a portion of each ridge being located on the leading edge 112. Each of the ridges 1601-1606 may have a greater width and height at the leading edge 112 than other parts of the ridge. Furthermore, the width and height of each of the ridges 1601-1606 may diminish from the leading edge 112 toward the rear 109 of the golf club head. In the examples of FIGS. 43 and 44, each ridge 1601-1606 includes a front surface 1620. The front surface 1620 of each ridge defines the most forward portion or front portion of the ridge. Although the most forward portion of a ridge is referred to herein as a front surface 1620, such a forward portion may be defined by one or more flat continuous or discontinuous surfaces, one or more continuous or discontinuous curved surfaces, one or more blunt or sharp edges, points, or a combination thereof. A portion or the entire front surface 1620 of each ridge may define a portion of the leading edge plane 1614, be spaced apart from but generally parallel to the leading edge plane 1614, or be spaced apart from and generally non-parallel to the leading edge plane 1614. According to one embodiment, the front surface 1620 may be positioned and configured such that any portion of the front surface 1620 may not extend beyond or through the leading edge plane 1614 that corresponds to the ridge defining the front surface 1620. The apparatus, methods, and articles of manufacture described herein are not limited in this regard.

Referring to FIG. 46-49, several examples of configurations, positions and angles of the front surface 1620 relative to the leading edge plane 1614 and/or the loft plane 1618 are shown. A certain leading edge angle 1616 may be required by one or more golf governing bodies. For example, a golf governing body may require that the crown 110 or the leading edge 112 of a golf club head does not include any objects or projections that extend beyond the leading edge plane 1614 having a certain leading edge angle 1616 relative to the loft plane 1618. In the example of FIGS. 46-49, the leading edge plane 1614 forms a leading edge angle 1616 of about 30° with the loft plane 1618. Thus, according to the examples of FIGS. 46-49, any turbulator 1600 located on or near the leading edge 112 may not have any portion thereof extend beyond the leading edge plane 1614. The leading edge angle 1616 may be any angle (e.g., 30°, 45°, 60°, etc.). Accordingly, describing a certain angle for the leading edge angle 1616, such as an angle of about 30° is exemplary and in no way limits the leading edge angle 1616 to a certain angle.

Figure 46:
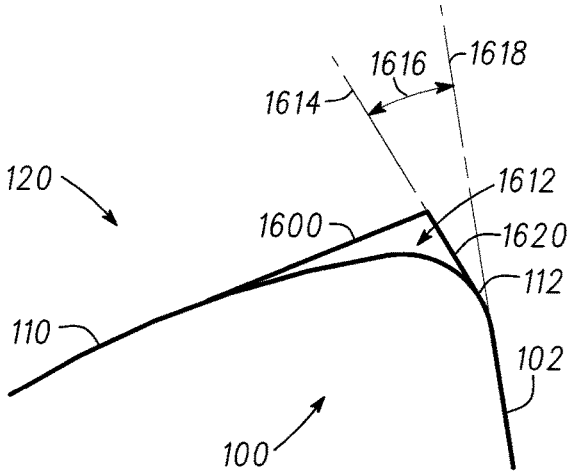
FIGS. 46-49 are schematic diagrams of turbulator configurations according to several embodiments.

Referring to the example of FIG. 46, the front surface 1620 or at least a cross-sectional portion of the front surface 1620 may generally define the leading edge plane 1614. Accordingly, the front surface 1620 is positioned as forward or near the face 102 of the golf club head as possible since any further forward positioning of the front surface 1620 would cause the front surface 1620 to extend beyond the leading edge plane 1614.

Figure 47:
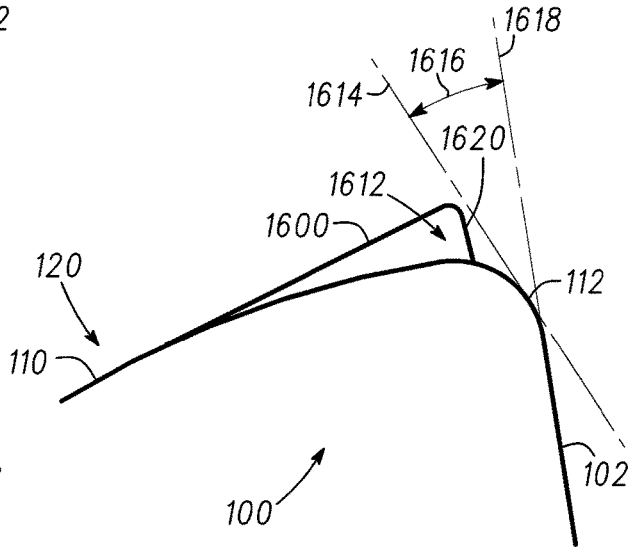

Referring to the example of FIG. 47, the front surface 1620 or at least a cross-sectional portion of the front surface 1620 may be generally parallel to the loft plane 1618. Accordingly, the front surface 1620 may be positioned behind or aft of the leading edge 112 so that no portion of the front surface 1620 extends beyond the leading edge plane 1614.

Figure 48:
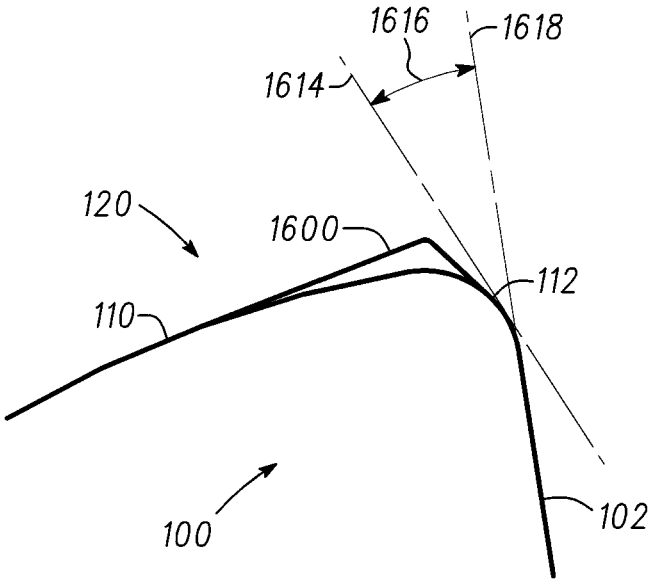

Referring to the example of FIG. 48, the front surface 1620 or at least a cross-sectional portion of the front surface 1620 extends from the leading edge 112 at an angle that is greater than the leading edge angle 1616. As shown in FIG. 48, however, a portion of the front surface 1620 may be tangent to the leading edge plane 1614. In other words, the front surface 1620 may extend from the leading edge 112, or as close to the leading edge 112 as possible, toward the rear 109 of the golf club head 100 at an angle that is greater than the leading edge angle 1616 without extending beyond the leading edge plane 1614.

Figure 49:
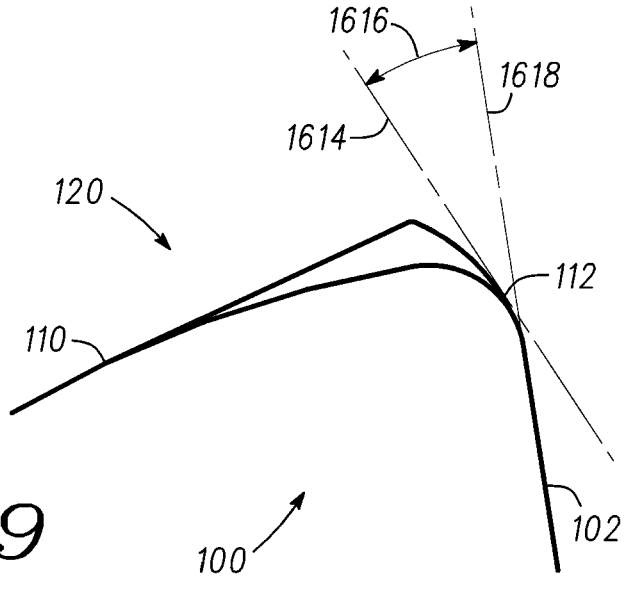

Referring to the example of FIG. 49, the front surface 1620 or at least a cross-sectional portion of the front surface 1620 extends from the leading edge 112 at an angle that is greater than the leading edge angle 1616. As shown in FIG. 47, however, a portion of the front surface 1620 may be tangent to the leading edge plane 1614. In other words, the front surface 1620 may extend from the leading edge 112, or as close to the leading edge 112 as possible, toward the back of the crown 110 at an angle that is greater than the leading edge angle 1616 without extending beyond the leading edge plane 1614. In the example of FIG. 47, at least a portion of the front surface 1620 or a cross section of at least a portion of the front surface 1620 may be curved, i.e., non-planar. The curvature of the front surface 1620 may vary in any direction, such as from the toe end 106 to the heel end 104.

The turbulators 1600 may be positioned at any location on the crown 110 so that a portion of the front surface 1620 of at least one of the turbulators 1600 is tangent to or is positioned aft of a leading edge plane 1614. The leading edge angle 1616 may be within any range, such as 0° to 90°. For example, as shown in the example of FIG. 46, a portion of the front surface 1620 of at least one turbulator 1600 may be located at the leading edge 112 of a golf club head 100. Alternatively, a portion of the front surface 1620 of at least one turbulator 1600 may be located aft of the leading edge 112 of a golf club head 100 as shown in FIGS. 47-49.

The turbulators 1600 may be sized, shaped and/or positioned on the crown 110 to provide any type of air flow properties over the crown 110. Each turbulator may have a certain length, width, height, longitudinal shape, cross-sectional shape, surface properties (i.e., texture or frictional properties), angular orientation, or any other physical characteristics that may provide certain flow characteristics over the crown 110. Examples of turbulator characteristics are provided in FIGS. 11-14. In the example of FIGS. 43 and 44, the ridge 1601 is longer than the ridges 1602-1606. Additionally, the turbulator 1601 has a greater curvature than the turbulators 1602-1606. Furthermore, the lengths and curvatures of the ridges 1601-1603 decrease from the toe end 106 to the center of the crown 110, while the lengths and curvatures of the turbulators 1604-1606 vary from the center of the crown 110 to the heel end 104.

The characteristics of each turbulator may depend on the profile of the separation region and the change in the location and the profile of the separation region during the entire golf club swing. For example, air flow separation may be greatest near the toe end 106 and decrease in a direction from the toe end 106 to the center of the crown 110. Accordingly, as shown in FIG. 44, the configuration of each of the turbulators 1601-1603 may be determined to delay separation along the profile of the separation region from the toe end 106 to the center of the crown 110. Thus, turbulators according to the disclosure may have any physical characteristics and be located at any location on the crown so as to provide delay in airflow separation on the crown for the entire golf swing.

Each ridge 1601-1606 may be oriented generally perpendicular, parallel or oblique relative to the leading edge 112 and/or relative to each other. Each ridge 1601-1606 may be curved, have variable base width along the length of the ridge, have variable cross-sectional shapes, have variable height along the length of the ridge and/or the width of the ridge, have sharp or blunt edges, front surfaces and/or trailing edges, have sharp or blunt tops, have different surface textures, and/or have other physical variations along the length, the width and/or the height of the ridge. The ridges 1601-1606 of the turbulators 1600 may be similar in many respects to other ridges of the turbulators according to the disclosure.

Figure 50:
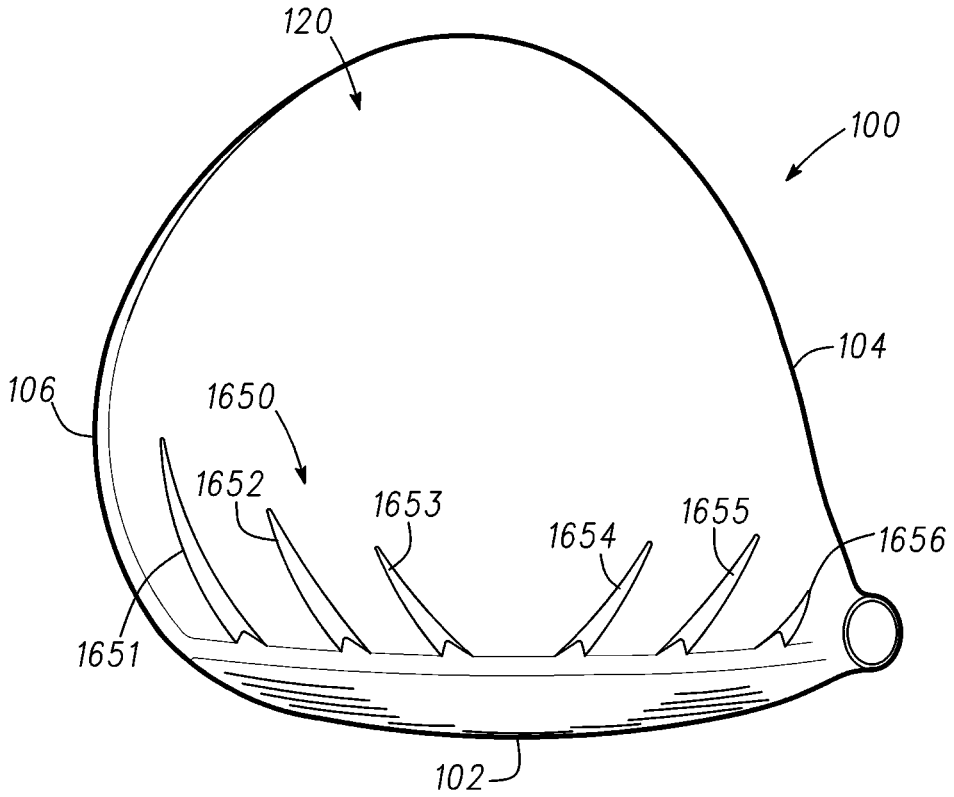
FIG. 50 is a perspective top view of a club head having turbulators according to one embodiment.

Referring to FIG. 50, a golf club head having a plurality of crown turbulators 1650 (e.g., two or more turbulators) according to another example is shown. The golf club head shown in FIG. 50 is similar in many respects to the golf club head 100 of FIGS. 9 and 10. Accordingly, except for the turbulators 1650, same parts of the golf club head of FIG. 50 and the golf club head 100 of FIGS. 9 and 10 are referred to with the same reference numbers. The turbulators 1600 may be defined by a plurality of ridges 1651-1656 that are positioned at or near the leading edge 112 and extend toward the separation region 120 or toward the rear 109 of the golf club head 100. The ridges 1651-1656 are similar in many respects to the ridges 1601-1606 described in detail above. Therefore, a detailed description of the ridges 1651-1656 is not described in detail herein for brevity.

Each ridge 1651-1656 may be oriented generally perpendicular, parallel or oblique relative to the leading edge 112 and/or relative to each other. For example, each ridge 1651-1656 may be oriented at an angle that may in a range of about 20° to about 70° relative to the leading edge 112. In the example of FIG. 50, the ridges 1651-1656 are oriented at an angle of about 70° relative to the leading edge 112. Each ridge 1651-1656 may be curved, have variable base width along the length of the ridge, have variable cross-sectional shapes, have variable height along the length of the ridge and/or the width of the ridge, have sharp or blunt edges, front surfaces and/or trailing edges, have sharp or blunt tops, have different surface textures, and/or have other physical variations along the length, the width and/or the height of the ridge. The ridges 1651-1656 may be similar in many respects to other ridges of the turbulators according to the disclosure.

Figure 51:
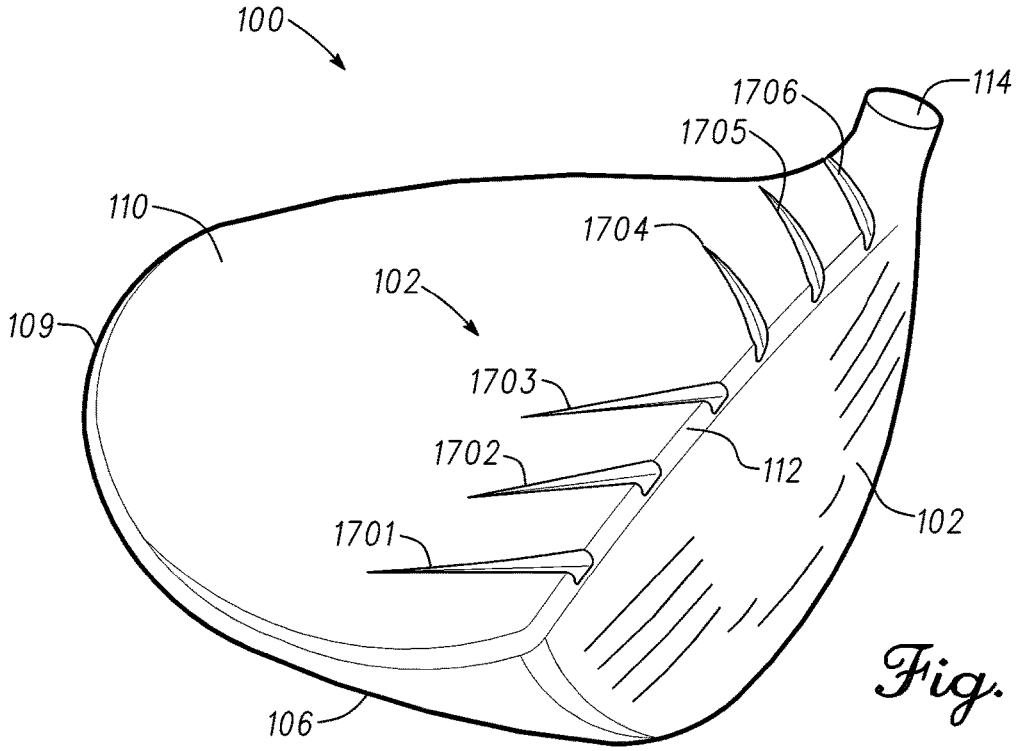
FIGS. 51 and 52 are perspective side and top views, respectively, of a club head having turbulators according to one embodiment.
Figure 52:
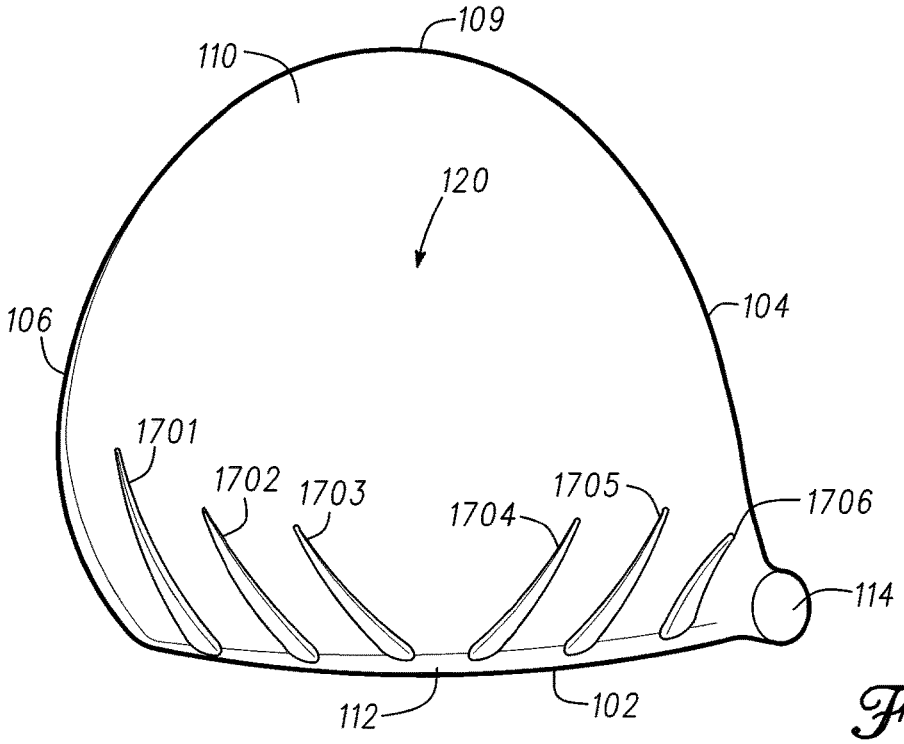

Referring to FIGS. 51 and 52, a golf club head having a plurality of turbulators 1700 according to another example is shown. The golf club head of FIGS. 51 and 52 is similar in many respects to the golf club head 100 of FIGS. 9 and 10.

Accordingly, except for the turbulators 1700, same parts of the golf club head 100 of FIGS. 51 and 52 and the golf club head 100 of FIGS. 9 and 10 are referred to with the same reference numbers. The turbulators 1700 are defined by a plurality of grooves 1701-1706 that are positioned at or near the leading edge 112 and extend toward the separation region 120 or toward the rear 109 of the golf club head 100. The grooves 1701-1707 may also be referred to herein as turbulators 1701-1706. The grooves 1701-1706 may extend into the separation region 120. While FIGS. 51 and 52 may depict a particular number of grooves, the apparatus, methods and articles of manufacture described herein may include more or less number of grooves.

Any one or all of the grooves 1701-1706 may be positioned on the crown 110 as close as possible to the leading edge 112 or at least partly on the leading edge 112 such that each groove does not extend beyond the leading edge plane 1614 (shown in FIG. 45). Alternatively, any one or all of the grooves 1701-1706 may be at least partly located on the leading edge 112 and extend beyond the leading edge plane 1614 (i.e., at least partly located between the leading edge plane 1614 and the loft plane 1618). Each of the grooves 1701-1706 may have any length, width, depth and/or cross-sectional profile, such as any profile according to the disclosure. As described above, each groove may be positioned at or near the leading edge 112 and extend toward the separation region 120 or the rear 109 of the golf club head 100. In the example of FIGS. 51 and 52, each groove extends from the leading edge 112 toward the rear 109 of the golf club head 100 with a portion of each groove being located on the leading edge 112. Each of the ridges 1701-1706 may have a greater width and depth at the leading edge 112 than other parts of the grooves. Furthermore, the width and depth of each of the grooves 1701-1706 may diminish from the leading edge 112 toward the rear 109 of the golf club head 100.

The turbulators 1700 may be sized, shaped and positioned on the crown to provide any type of air flow properties over the crown. Each turbulator 1700 may have a certain length, width, depth, longitudinal shape, cross-sectional shape, surface properties (i.e., texture or frictional properties), angular orientation, or any other physical characteristics that may provide certain flow characteristics over the crown. In the example of FIGS. 51 and 52, the turbulator 1701 is longer than the turbulators 1702-1706. Additionally, the turbulator 1701 has a greater curvature than the turbulators 1702-1706. Furthermore, the lengths and curvatures of the turbulators 1701-1703 decrease from the toe end 106 to the center of the crown 110, while the lengths and curvatures of the turbulators 1704-1706 vary from the center of the crown 110 to the heel end 104. The characteristics of each turbulator may depend on the profile of the separation region and the change in the location and the profile of the separation region during the entire golf club swing. For example, air flow separation may be greatest near the toe end 106 and reduce in a direction from the toe end 106 to the center of the crown 110. Accordingly, as shown in FIG. 52, the locations and physical properties of the turbulators 1701-1703 may be determined to delay separation along the profile of the separation region from the toe end 106 to the center of the crown 110. Thus, turbulators according to the disclosure may have any physical characteristics and be located at any location on the crown so as to provide delay in airflow separation on the crown for the entire golf swing.

Each groove 1701-1706 may be oriented generally perpendicular, parallel or oblique relative to the leading edge 112 and/or relative to each other. For example, each groove 1701-1706 may be oriented at an angle between 20° and 70° relative to the leading edge 112. Each groove 1701-1706 may be curved, have variable base width along the length of the grooves, have variable cross-sectional shapes, have variable depth along the length of the groove and/or the width of the groove, have sharp or blunt groove edges, have different surface textures, and/or have other physical variations along the length, the width and/or the depth of the groove.

A club head may include one or a combination of the turbulators 300, 400, 500, 600, 1200, 1300, 1600 and/or 1700; and/or grooves 1400 and 1500. For example, a club head may include the turbulators 400 on the crown and turbulators 1200 on the sole. In another example, a club head may include the turbulators 500 on the crown and turbulators 1200 and 1300 on the sole. Thus, any combination of turbulators according to the disclosure may be provided on the crown and/or the sole to provide a particular flow pattern on the club head. Furthermore, any combination of turbulators as described herein may be provided with the grooves on the sole 1008 of the golf club head according to the examples of FIGS. 39 and 40. Any or a combination of the methods described herein for forming ridges or grooves may be used to form any of the ridges or grooves according to the disclosure.

Any reference made herein to certain parts of a golf club head such as a face, a rear, a heel or heel end, a toe or toe end, a crown and a sole of a golf club head may refer to portions of the golf club head that generally represent those parts.

Although a particular order of actions is described above for making turbulators or club heads with turbulators, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

Although certain example systems, methods, apparatus, and articles of manufacture have been described herein, the scope of coverage of this disclosure is not limited thereto. On the contrary, this disclosure covers all systems, methods, apparatus, and articles of manufacture fairly falling within the scope of the appended claims either literally or under the doctrine of equivalents.

What is claimed is:

1. A golf club head comprising:

a face portion defining a loft plane, a rear portion, a heel end, a toe end, a sole portion, a crown portion, a leading edge positioned between the face portion and the crown portion;

the leading edge portion defining a leading edge plane forming a leading edge angle with the loft plane; and an apex positioned at a highest point on the crown portion;

a turbulator projecting outwardly from the crown portion positioned at least partially between the leading edge and the apex;

the turbulator extending at least partially between the face portion and the rear portion to define a width, and wherein the turbulator is fixedly attached to the crown of the golf club head;

the turbulator extending a distance at least partially between the heel end and the toe end;

the turbulator having a front portion defining a portion of the turbulator closest to the face portion, the front portion of the turbulator being at least partly located on the leading edge portion and between the leading edge plane and the rear portion, but not extending beyond the leading edge plane, wherein the turbulator is oriented at an oblique angle between 20 and 70 degrees to the leading edge.

2. The golf club head of claim 1, wherein the turbulator on the crown portion is a continuous strip extending from the heel end to the toe end.

3. The golf club head of claim 2, wherein the width of the turbulator on the crown portion is less than the distance the turbulator extends from the heel end to the toe end.

4. The golf club head of claim 1, wherein the turbulator on the crown comprises a plurality of turbulator segments projecting outwardly from the crown portion.

5. The golf club head of claim 4, wherein at least one of the plurality of turbulator segments has a length greater than the distance it extends from the heel end to the toe end.

6. The golf club head of claim 1, wherein the width of the turbulator on the crown portion is less than 0.75 inch.

7. The golf club head of claim 1, wherein the turbulator on the crown portion is positioned between 0.25 inch and 4.5 inches from the face portion.

8. The golf club head of claim 1, wherein at least a portion of the turbulator on the crown is positioned on the leading edge.

9. The golf club head of claim 1, wherein the turbulator on the crown comprises a height within the range of 0.02 inch to 0.5 inch.

10. The golf club head of claim 1, wherein a sole turbulators comprise a height which varies from the heel end to the toe end.

11. The golf club head of claim 1, wherein the turbulator is fixedly attached to the crown of the golf club head by adhesion.

12. The golf club head of claim 1, wherein the turbulators are composed of a plastic or composite material, and is a different material than the golf club head.

13. A golf club head comprising:

a face portion defining a loft plane, a rear portion, a heel end, a toe end, a sole portion, a crown portion, a leading edge positioned between the face portion and the crown portion;

the leading edge portion defining a leading edge plane forming a leading edge angle with the loft plane and an apex positioned at a highest point on the crown portion;

a turbulator projecting outwardly from the crown portion positioned at least partially between the leading edge and the apex;

the turbulator extending at least partially between the face portion and the rear portion to define a width, and wherein the turbulator is removably attached to the crown of the golf club head; and wherein:

the turbulator extending a distance at least partially between the heel end and the toe end;

the turbulator having a front portion defining a portion of the turbulator closest to the face portion, the front portion of the turbulator being at least partly located on the leading edge portion and between the leading edge plane and the rear portion, but not extending beyond the leading edge plane, wherein the turbulator is oriented at an oblique angle between 20 and 70 degrees to the leading edge; and a plurality of sole turbulators defined by grooves are disposed in the sole portion.

14. The golf club head of claim 13, wherein at least one sole turbulator of the first plurality of sole turbulators or the second plurality of sole turbulators is curved.

15. The golf club head of claim 13, further comprising:

a centerline extending perpendicularly from a center portion of the face portion towards the rear portion of the club head; and the plurality of sole turbulators comprising a first end and a second end, wherein the second end of at least one of the first plurality of sole turbulators is positioned closer to the centerline than the first end of the at least one sole turbulator of the first plurality of sole turbulators.

16. The golf club head of claim 13, wherein the first plurality of sole turbulators and the second plurality of sole turbulators progressively increase in length in a direction from the face portion towards the toe end.

17. The golf club head of claim 13, wherein a distance separating a first sole turbulator of the first plurality of sole turbulators from a second sole turbulator of the first plurality of sole turbulators remains constant across the length of the first and second sole turbulators.

18. The golf club head of claim 13, wherein a depth of at least one of the sole turbulators of the second plurality of sole turbulators varies across its length.

19. The golf club head of claim 13, wherein a side wall of at least one of the sole turbulators of the second plurality of sole turbulators is non-perpendicular relative to a bottom of the at least one sole turbulator.

20. The golf club head of claim 13, wherein the turbulator is removably attached to the crown of the golf club head with fasteners, and is a different material than the remainder of the golf club head.

* * * * *